US009846378B2

(12) United States Patent
Iwasaki

(10) Patent No.: US 9,846,378 B2
(45) Date of Patent: Dec. 19, 2017

(54) ELECTROPHOTOGRAPHIC PHOTORECEPTOR, PROCESS CARTRIDGE, IMAGE FORMING APPARATUS, AND CONDUCTIVE SUBSTRATE THAT MAY BE INCLUDED IN ELECTROPHOTOGRAPHIC PHOTORECEPTOR

(71) Applicant: FUJI XEROX CO., LTD., Tokyo (JP)

(72) Inventor: Masahiro Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/207,687

(22) Filed: Jul. 12, 2016

(65) Prior Publication Data

US 2017/0261874 A1 Sep. 14, 2017

(30) Foreign Application Priority Data

Mar. 10, 2016 (JP) ..... 2016-047272

(51) Int. Cl.

| | |
|---|---|
| ***G03G 5/00*** | (2006.01) |
| ***G03G 5/14*** | (2006.01) |
| ***G03G 5/10*** | (2006.01) |
| ***G03G 5/06*** | (2006.01) |
| ***G03G 5/05*** | (2006.01) |
| ***G03G 21/18*** | (2006.01) |

(52) U.S. Cl.

CPC ..... *G03G 5/142* (2013.01); *G03G 5/0564* (2013.01); *G03G 5/0609* (2013.01); *G03G 5/0614* (2013.01); *G03G 5/0618* (2013.01); *G03G 5/0696* (2013.01); *G03G 5/10* (2013.01); *G03G 5/102* (2013.01); *G03G 21/18* (2013.01)

(58) Field of Classification Search

CPC ..... G03G 5/10; G03G 5/102
USPC ..... 430/69
See application file for complete search history.

(56) References Cited

U.S. PATENT DOCUMENTS

| | | | | |
|---|---|---|---|---|
| 5,254,411 | A * | 10/1993 | Takeda | B05D 3/04 427/377 |
| 5,298,617 | A | 3/1994 | Nukada et al. | |
| 5,302,479 | A | 4/1994 | Daimon et al. | |
| 5,459,004 | A | 10/1995 | Daimon et al. | |
| 2006/0254933 | A1 * | 11/2006 | Adachi | G01N 35/08 205/777 |
| 2016/0363881 | A1 * | 12/2016 | Urushihara | G03G 15/0808 |

FOREIGN PATENT DOCUMENTS

| | | | |
|---|---|---|---|
| JP | 4-189873 | A | 7/1992 |
| JP | 4-278957 | A | 10/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 2004-78147 | A | 3/2004 |
| JP | 2005-181992 | A | 7/2005 |
| JP | 5721610 | B2 | 5/2015 |

* cited by examiner

*Primary Examiner* — Mark A Chapman
(74) *Attorney, Agent, or Firm* — Sughrue Mion, PLLC

(57) ABSTRACT

An electrophotographic photoreceptor includes a conductive substrate including an outer peripheral surface treated with a silazane; and a photosensitive layer on the outer peripheral surface of the conductive substrate. The photosensitive layer includes a charge generating material and a charge transporting material.

14 Claims, 3 Drawing Sheets

ELECTROPHOTOGRAPHIC PHOTORECEPTOR, PROCESS CARTRIDGE, IMAGE FORMING APPARATUS, AND CONDUCTIVE SUBSTRATE THAT MAY BE INCLUDED IN ELECTROPHOTOGRAPHIC PHOTORECEPTOR

CROSS-REFERENCE TO RELATED APPLICATIONS

This application is based on and claims priority under 35 USC 119 from Japanese Patent Application No. 2016-047272 filed Mar. 10, 2016.

BACKGROUND (i) Technical Field

The present invention relates to an electrophotographic photoreceptor, a process cartridge, an image forming apparatus, and a conductive substrate that may be included in an electrophotographic photoreceptor.

(ii) Related Art

In the production of electrophotographic photoreceptors, the outer surface of a conductive substrate is cleaned, and a photosensitive layer is formed on the conductive substrate by coating. For cleaning the outer surface of the conductive substrate, water, warm water, regenerated water, and the like are commonly used as a cleaning liquid. Therefore, a considerable amount of hydroxyl groups may be present on the outer surface of the conductive substrate. If images are formed using such an electrophotographic photoreceptor particularly in a high-temperature, high-humidity environment, where water molecules are likely to adsorb to the conductive substrate, charge may leak locally in the photoreceptor via the water molecules and the photoreceptor may be corroded. This local defects may result in the formation of dot-like image defects (i.e., color spots). The above image defects are particularly likely to occur in an electrophotographic photoreceptor that does not include an undercoat layer.

SUMMARY

According to an aspect of the invention, there is provided an electrophotographic photoreceptor including a conductive substrate including an outer peripheral surface treated with a silazane; and a photosensitive layer on the outer peripheral surface of the conductive substrate, the photosensitive layer including a charge generating material and a charge transporting material.

BRIEF DESCRIPTION OF THE DRAWINGS

Exemplary embodiments of the present invention will be described in detail based on the following figures, wherein.

DETAILED DESCRIPTION

Figure 1:
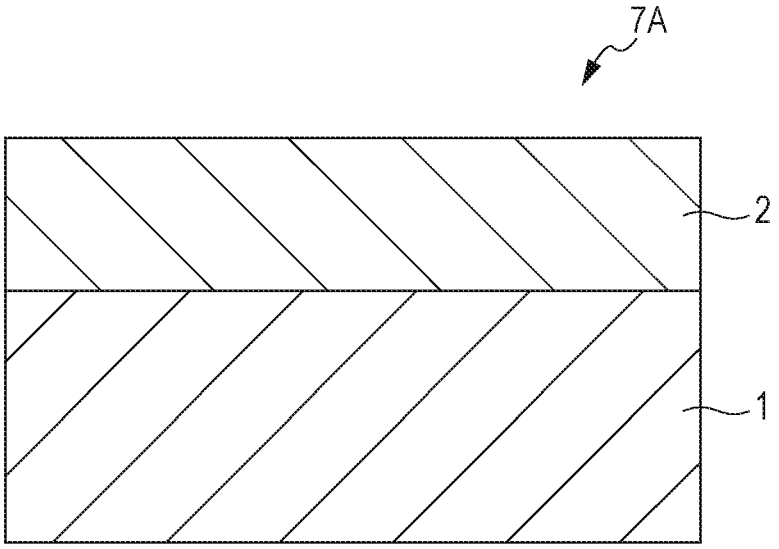
FIG. 1 is a schematic, partial cross-sectional view of an example of an electrophotographic photoreceptor according to an exemplary embodiment, illustrating layers that constitute the electrophotographic photoreceptor.

Exemplary embodiments of the invention are described below with reference to the attached drawings. Throughout the drawings, elements having the same function are denoted by the same reference numeral, and duplicate description is omitted.

Electrophotographic Photoreceptor

An electrophotographic photoreceptor according to this exemplary embodiment (hereinafter, referred to simply as "photoreceptor") includes a conductive substrate having an outer peripheral surface treated with a silazane; and a photosensitive layer disposed on the outer peripheral surface of the conductive substrate. The photosensitive layer includes a charge generating material and a charge transporting material.

The photosensitive layer may be a photosensitive layer constituted by a charge generating layer and a charge transporting layer that have separate functions (hereinafter, such a photosensitive layer is referred to as "separated-function photosensitive layer") or a photosensitive layer including only one layer (hereinafter, such a photosensitive layer is referred to as "single-layer photosensitive layer"). When the photosensitive layer is a separated-function photosensitive layer, the charge generating layer includes the charge generating material, and the charge transporting layer includes the charge transporting material.

It is considered that an electrophotographic photoreceptor having the above-described structure may reduce the likelihood of charge leaking locally in the photoreceptor and the occurrence of dot-like image defects due to the leakage of charge by the following mechanisms.

Hydroxyl groups are likely to remain on the surface of a conductive substrate included in an electrophotographic photoreceptor. For example, even an aluminium substrate having a boehmite-treated surface includes a small amount of hydroxyl groups derived from aluminium hydroxide on the surface. When an electrophotographic photoreceptor including a conductive substrate on which hydroxyl groups are present is used, water molecules are likely to adsorb to the hydroxyl groups of the conductive substrate particularly in a high-temperature, high-humidity environment (e.g., temperature: 30° C., humidity: 85%). If images are formed using an electrophotographic photoreceptor including a conductive substrate including water molecules adsorbed onto the outer peripheral surface, charge may leak locally in the photoreceptor via the water molecules. Furthermore, the leakage of charge may result in the formation of dot-like image defects (i.e., color spots).

In order to address this, the electrophotographic photoreceptor according to this exemplary embodiment includes a conductive substrate having an outer peripheral surface treated with a silazane. Hereinafter, a conductive substrate having an outer peripheral surface treated with a silazane is referred to as "silazane-treated conductive substrate", and a conductive substrate having an outer peripheral surface that has not yet been treated with a silazane is referred to as "pre-silazane-treatment conductive substrate".

In the silazane-treated conductive substrate, all the hydroxyl groups or hydrogen atoms included in the hydroxyl groups that are present on the outer peripheral surface of the pre-silazane-treatment conductive substrate are replaced with a silyl group included in a silazane, which is bonded to a nitrogen atom constituting a Si—N bond. A silazane has a structure represented by, for example, General Formula (S) and has high reactivity with hydroxyl groups. When the surface of a conductive substrate on which hydroxyl groups are present is treated with a silazane having a structure represented by General Formula (S), dissociation of Si—N bonds occurs and the hydroxyl (—OH) groups or hydrogen (—H) atoms of the hydroxyl groups are replaced with a silyl group represented by General Formula (A). Hereinafter, the silyl group represented by General Formula (A) may be denoted by "-A". For example, in the case where a conductive substrate composed of aluminium is treated with a silazane, hydroxyl groups bonded to the aluminium surface, that is, "Al—OH", are replaced with a silyl group "-A" to form "Al—O-A" or "Al-A".

(S)

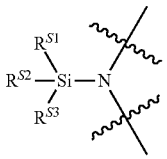

(A)

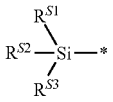

In General Formula (S), $R^{S1}$ to $R^{S3}$ each independently represent a hydrogen atom or a monovalent organic group. In General Formula (A), $R^{S1}$ to $R^{S3}$ represent the same groups (i.e., a hydrogen atom or a monovalent organic group) as those represented by $R^{S1}$ to $R^{S3}$ in General Formula (S), respectively; and * denotes the position at which the silyl group is bonded to the outer peripheral surface of a conductive substrate.

One possible way to replace hydroxyl groups present on the outer peripheral surface of a pre-silazane-treatment conductive substrate with a silyl group is to perform silylation of the outer peripheral surface with a silane coupling agent. A common example of the silane coupling agent is a compound represented by X—Si—$(OR^c)_3$, where X and $R^c$ each independently represent a monovalent organic group. In the silylation of the outer peripheral surface with a silane coupling agent, the silane coupling agent is converted to X—Si—$(OH)_3$ by hydrolysis, and dehydration condensation of silanol groups included in the converted silane coupling agent with hydroxyl groups present on the surface of the conductive substrate is performed by heating.

However, since the above dehydration condensation reaction is performed with lower reactivity than a reaction of a silazane with hydroxyl groups, some of the hydroxyl groups which have not been replaced with a silyl group may remain on the outer peripheral surface of the conductive substrate even after the silylation of the outer peripheral surface of the pre-silazane-treatment conductive substrate with a silane coupling agent has been performed. In addition, since the silane coupling agent degraded by hydrolysis includes plural hydroxyl groups (i.e., silanol groups), some of the hydroxyl groups (i.e., silanol groups) included in silyl groups bonded to the outer peripheral surface of the conductive substrate may remain without being subjected to dehydration condensation.

In contrast, a silazane has higher reactivity with hydroxyl groups and is less likely to produce hydroxyl groups when degraded by hydrolysis than a silane coupling agent. Therefore, treating the outer peripheral surface of the conductive substrate with a silazane, which is less likely to produce hydroxyl groups (i.e., silanol groups) when degraded by hydrolysis, enables the amount of hydroxyl groups present on the outer peripheral surface of the conductive substrate to be reduced, in addition to causing hydroxyl groups present on the outer peripheral surface of the conductive substrate to be replaced with silyl groups "-A".

Using the above-described silazane-treated conductive substrate, that is, a conductive substrate having a reduced amount of hydroxyl groups present on the outer peripheral surface, reduces the likelihood of water molecules adsorbing onto the outer peripheral surface of the conductive substrate. Consequently, the likelihood of charge leaking locally in the photoreceptor via the water molecules and the occurrence dot-like image defects due to the leakage of charge may be reduced.

The above-described electrophotographic photoreceptor is considered to reduce the likelihood of charge leaking locally in the photoreceptor and the occurrence dot-like image defects due to the leakage of charge by the above-described mechanisms.

The electrophotographic photoreceptor according to this exemplary embodiment is described in detail with reference to the attached drawings.

FIG. 1 is a schematic, partial cross-sectional view of an electrophotographic photoreceptor 7A, which is an example of the electrophotographic photoreceptor according to this exemplary embodiment, illustrating layers constituting the electrophotographic photoreceptor.

The electrophotographic photoreceptor 7A illustrated in FIG. 1 includes, for example, a conductive substrate 1 and a single-layer photosensitive layer 2 disposed on the conductive substrate 1.

The electrophotographic photoreceptor 7A may optionally include other layers. Examples of the other layers include an undercoat layer interposed between the conductive substrate 1 and the single-layer photosensitive layer 2 and a protection layer disposed on the single-layer photosensitive layer 2.

The conductive substrate 1 include in the electrophotographic photoreceptor 7A illustrated in FIG. 1 is a silazane-treated conductive substrate.

The electrophotographic photoreceptor 7A illustrated in FIG. 1 may be produced by, for example, a method including preparing a pre-silazane-treatment conductive substrate; treating the outer peripheral surface of the pre-silazane-treatment conductive substrate with a silazane in order to prepare a silazane-treated conductive substrate (i.e., conductive substrate 1); and forming a single-layer photosensitive layer 2 including a charge generating material and a charge transporting material on the outer peripheral surface of the silazane-treated conductive substrate (i.e., conductive substrate 1).

Figure 2:
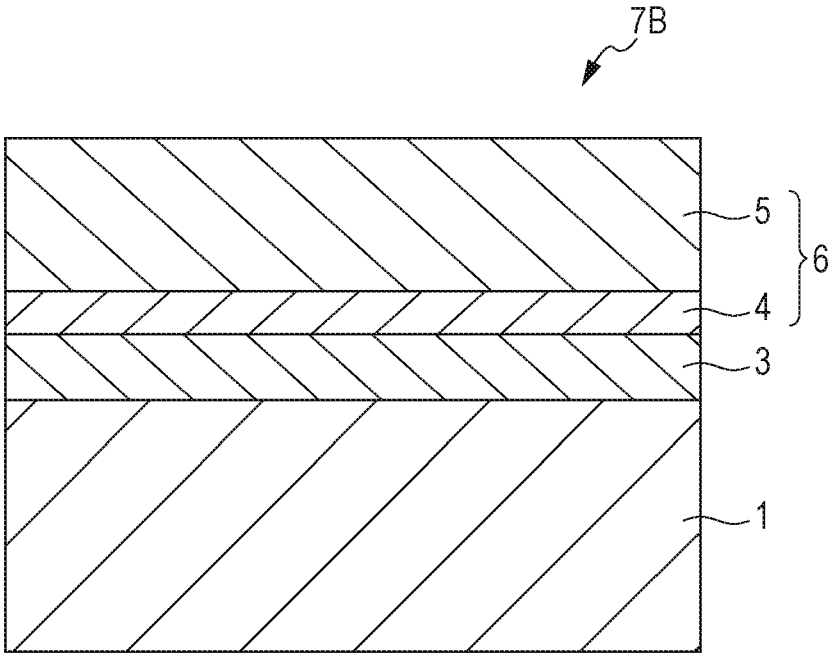
FIG. 2 is a schematic, partial cross-sectional view of another example of an electrophotographic photoreceptor according to an exemplary embodiment, illustrating layers that constitute the electrophotographic photoreceptor.

FIG. 2 is a schematic, partial cross-sectional view of an electrophotographic photoreceptor 7B, which is another example of the electrophotographic photoreceptor according to this exemplary embodiment, illustrating layers constituting the electrophotographic photoreceptor.

The electrophotographic photoreceptor 7B illustrated in FIG. 2 includes a conductive substrate 1, an undercoat layer 3, a charge generating layer 4, and a charge transporting layer 5 that are stacked on top of one another in this order. The charge generating layer 4 and the charge transporting layer 5 constitute a separated-function photosensitive layer 6.

The electrophotographic photoreceptor 7B does not necessarily include the undercoat layer 3. The electrophotographic photoreceptor 7B may optionally include other layers. An example of the other layers is a protection layer disposed on the charge transporting layer 5.

Similarly to the conductive substrate 1 of the electrophotographic photoreceptor 7A, the conductive substrate 1 included in the electrophotographic photoreceptor 7B illustrated in FIG. 2 is a silazane-treated conductive substrate.

The electrophotographic photoreceptor 7B illustrated in FIG. 2 may be produced by, for example, a method including preparing a pre-silazane-treatment conductive substrate; treating the outer peripheral surface of the pre-silazane-treatment conductive substrate with a silazane in order to form a silazane-treated conductive substrate (i.e., conductive substrate 1); forming an undercoat layer 3 on the outer peripheral surface of the silazane-treated conductive substrate (i.e., conductive substrate 1); and forming a separated-function photosensitive layer 6 including a charge generating material and a charge transporting material on the undercoat layer 3. The step of forming the separated-function photosensitive layer 6 includes a substep in which a charge generating layer 4 including the charge generating material is formed on the undercoat layer 3 and a substep in which a charge transporting layer 5 including the charge transporting material is formed on the charge generating layer 4.

The above layers constituting the electrophotographic photoreceptor according to this exemplary embodiment are each described below in detail. In the following description, reference numerals are omitted.

Conductive Substrate

Examples of the conductive substrate include a metal sheet, a metal drum, and a metal belt that include a metal such as aluminium, copper, zinc, chromium, nickel, molybdenum, vanadium, indium, gold, or platinum or an alloy such as stainless steel. Other examples of the conductive substrate include a paper sheet, a resin film, and a belt on which a conductive compound such as a conductive polymer or indium oxide, a metal such as aluminium, palladium, or gold, or an alloy is deposited by coating, vapor deposition, or lamination. The term "conductive" used herein refers to having a volume resistivity of less than $10^{13}$ Ωcm.

The conductive substrate may include aluminium in order to have electrical properties suitable for an electrophotographic photoreceptor. In particular, a conductive substrate composed of aluminium or an aluminium alloy may be used. Examples of the aluminum alloy that may constitute the conductive substrate include aluminium alloys including aluminium and at least one element selected from Si, Fe, Cu, Mn, Mg, Cr, Zn, and Ti. The aluminium content in the aluminium alloy constituting the conductive substrate may be, for example, 50% by weight or more. From the viewpoint of the workability of the aluminium alloy, the aluminium content in an aluminium alloy is preferably 90.0% by weight or more, is more preferably 93.0% by weight or more, and is further preferably 95.0% by weight or more.

The conductive substrate used in this exemplary embodiment is a conductive substrate having an outer peripheral surface treated with a silazane, that is, a silazane-treated conductive substrate.

The term "silazane" used herein refers to a compound including a Si—N bond. As described above, a silazane has a structure represented by, for example, General Formula (S) above. When the outer peripheral surface of a pre-silazane-treatment conductive substrate is treated with a silazane, hydroxyl (—OH) groups present on the outer peripheral surface of the conductive substrate or hydrogen (—H) atoms included in the hydroxyl groups are replaced with a silyl group "-A" included in the silazane, which is represented by General Formula (A) above. As a result, a conductive substrate including silyl groups "-A" present on the outer peripheral surface, that is, a silazane-treated conductive substrate, is formed.

Silyl groups "-A" present on the outer peripheral surface of the silazane-treated conductive substrate, that is, silyl groups included in the silazane used in the above treatment (hereinafter, referred to as "silazane treatment), preferably do not include an OH group and more preferably do not include either an OH group or a Si—O bond in order to reduce the occurrence of dot-like image defects. Among atoms constituting the groups represented by $R^{S1}$ to $R^{S3}$ in General Formula (A), an atom bonded directly to a Si atom may be at least one selected from a hydrogen atom, a carbon atom, and a Si atom.

The molecular weight of the silyl groups "-A" may be, for example, 50 or more and 250 or less and is preferably 55 or more and 200 or less in order to reduce the occurrence of dot-like image defects.

Examples of the monovalent organic groups represented by $R^{S1}$ to $R^{S3}$ in General Formula (A) include an unsubstituted or substituted alkyl group, an unsubstituted or substituted cycloalkyl group, an unsubstituted or substituted aryl group, and an unsubstituted or substituted silyl group.

Examples of the alkyl groups represented by $R^{S1}$ to $R^{S3}$ include a linear alkyl group having 1 to 20 carbon atoms and preferably 1 to 10 carbon atoms and a branched alkyl group having 3 to 10 carbon atoms and preferably 3 or 4 carbon atoms.

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a t-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Examples of a group with which the alkyl groups represented by $R^{S1}$ to $R^{S3}$ may be substituted include a halogen atom, a cycloalkyl group, an aryl group, a silyl group, an alkoxy group, an alkylthio group, and an amino group.

Examples of the halogen atom with which the alkyl groups may be substituted include a fluorine atom, a chlorine atom, a bromine atom, and an iodine atom.

Examples of the cycloalkyl group, aryl group, and silyl group with which the alkyl groups may be substituted are the same as the examples of the cycloalkyl groups, the aryl groups, and the silyl groups represented by $R^{S1}$ to $R^{S3}$ which are described below, respectively.

Examples of the alkoxy group with which the alkyl groups may be substituted include a group constituted by an alkyl group and a —O— group bonded to the alkyl group. Examples of the alkylthio group with which the alkyl groups may be substituted include a group constituted by an alkyl group and a —S— group bonded to the alkyl group. Examples of the alkyl group bonded to the —O— or —S— group are the same as the above-described examples of the alkyl groups represented by $R^{S1}$ to $R^{S3}$.

Examples of the amino group with which the alkyl groups may be substituted include a primary amine (—$NH_2$); an alkyl-substituted amino group, that is, an alkylamino group (i.e., secondary amine); and an amino group to which two alkyl groups are bonded, that is, a dialkylamino group (i.e., tertiary amine). Examples of the alkyl group included in the alkylamino group or the dialkylamino group are the same as the above-described examples of the alkyl groups represented by $R^{S1}$ to $R^{S3}$.

Examples of the cycloalkyl groups represented by $R^{S1}$ to $R^{S3}$ include a cycloalkyl group having 3 to 12 carbon atoms and preferably 4 to 8 carbon atoms.

Specific examples of the cycloalkyl groups include a cyclopropyl group, a cyclobutyl group, a cyclopentyl group, a cyclohexyl group, a cycloheptyl group, and a cyclooctyl group.

Examples of a group with which the cycloalkyl groups represented by $R^{S1}$ to $R^{S3}$ may be substituted include a halogen atom, an alkyl group, an aryl group, a silyl group, an alkoxy group, an alkylthio group, and an amino group.

Examples of the halogen atom, the alkoxy group, the alkylthio group, and the amino group with which the cycloalkyl groups may be substituted are the same as the above-described examples of the halogen atom, the alkoxy group, the alkylthio group, and the amino group with which the alkyl groups may be substituted, respectively.

Examples of the alkyl group with which the cycloalkyl groups may be substituted are the same as the above-described examples of the alkyl groups represented by $R^{S1}$ to $R^{S3}$.

Examples of the aryl group and the silyl group with which the cycloalkyl groups may be substituted are the same as the examples of the aryl groups and the silyl groups represented by $R^{S1}$ to $R^{S3}$ which are described below.

Examples of the aryl groups represented by $R^{S1}$ to $R^{S3}$ include an aryl group having 6 to 18 carbon atoms and preferably 6 to 12 carbon atoms.

Specific examples of the aryl group include a phenyl group, a naphthyl group, a phenanthryl group, and a biphenylyl group.

Examples of a group with which the aryl groups represented by $R^{S1}$ to $R^{S3}$ may be substituted include a halogen atom, an alkyl group, a cycloalkyl group, a silyl group, an alkoxy group, an alkylthio group, and an amino group.

Examples of the halogen atom, the alkoxy group, the alkylthio group, and the amino group with which the aryl groups may be substituted are the same as the above-described examples of the halogen atom, the alkoxy group, the alkylthio group, and the amino group with which the alkyl groups may be substituted, respectively.

Examples of the alkyl group and the cycloalkyl group with which the aryl groups may be substituted are the same as the above-described examples of the alkyl groups and the cycloalkyl groups represented by $R^{S1}$ to $R^{S3}$, respectively.

Examples of the silyl group with which the aryl groups may be substituted are the same as the examples of the silyl groups represented by $R^{S1}$ to $R^{S3}$ which are described below, respectively.

Examples of the silyl groups represented by $R^{S1}$ to $R^{S3}$ include a —$SiH_3$ group.

Examples of a group with which the silyl groups represented by $R^{S1}$ to $R^{S3}$ may be substituted include a halogen atom, an alkyl group, a cycloalkyl group, an aryl group, a silyl group, an alkoxyalkyl group, an alkylthioalkyl group, and an aminoalkyl group.

Examples of the halogen atom with which the silyl groups may be substituted are the same as the above-described examples of the halogen atom with which the alkyl groups may be substituted.

Examples of the alkyl group, the cycloalkyl group, the aryl group, and the silyl group with which the silyl groups may be substituted are the same as the above-described examples of the alkyl groups, the cycloalkyl groups, the aryl groups, and the silyl groups represented by $R^{S1}$ to $R^{S3}$, respectively.

Examples of the alkoxyalkyl group, the alkylthioalkyl group, and the aminoalkyl group with which the silyl groups may be substituted are the above-described examples of the alkyl groups represented by $R^{S1}$ to $R^{S3}$ which are substituted with a group selected from the above-described examples of the alkoxy group, the alkylthio group, and the amino group with which the alkyl groups may be substituted, respectively.

In order to reduce the occurrence of dot-like image defects, $R^{S1}$ to $R^{S3}$ in General Formula (A) are preferably a hydrogen atom, an unsubstituted or substituted alkyl group, an unsubstituted or substituted aryl group, or an unsubstituted or substituted silyl group; are more preferably a hydrogen atom, an unsubstituted alkyl group having 1 to 4 carbon atoms, an unsubstituted or substituted phenyl group, or an unsubstituted silyl group; and are further preferably a hydrogen atom, an unsubstituted, linear alkyl group having 1 or 2 carbon atoms, an unsubstituted, branched alkyl group having 3 or 4 carbon atoms, an unsubstituted phenyl group, a phenyl group substituted with a halogen atom, or an unsubstituted silyl group.

The groups represented by $R^{S1}$ to $R^{S3}$ in General Formula (A) may be the same as or different from one another. It is preferable that two or more groups selected from the groups represented by $R^{S1}$ to $R^{S3}$ be the same. It is more preferable that all the groups represented by $R^{S1}$ to $R^{S3}$ be the same. In particular, it is preferable that two or more groups selected from the groups represented by $R^{S1}$ to $R^{S3}$ be monovalent organic groups, and it is more preferable that all the groups represented by $R^{S1}$ to $R^{S3}$ be monovalent organic groups.

Specific examples of the structure represented by General Formula (A) include, but are not limited to, the following.

A-1

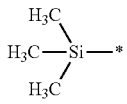

A-2

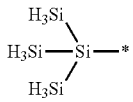

A-3

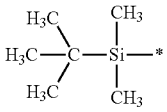

A-4

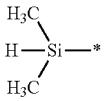

A-5

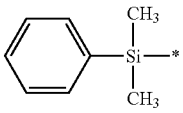

-continued

A-6

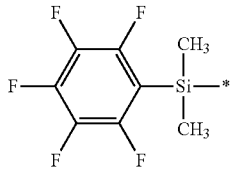

A silazane-treated conductive substrate may be produced by, for example, a method including preparing a pre-silazane-treatment conductive substrate; and treating the outer peripheral surface of the pre-silazane-treatment conductive substrate with a silazane.

The type of the silazane with which the outer peripheral surface of the pre-silazane-treatment conductive substrate is treated is not limited, and any type of silazane including a Si—N bond may be used. In particular, the silyl group bonded directly to a nitrogen atom constituting a Si—N bond may be the silyl group represented by General Formula (A) above.

The silyl group bonded directly to a nitrogen atom of the Si—N bond of the silazane preferably does not include an OH group and more preferably does not include either an OH group or a Si—O bond in order to reduce the occurrence of dot-like image defects.

The molecular weight of the silazane may be, for example, 100 or more and 300 or less and is preferably 110 or more and 200 or less in order to enhance the reactivity of the silazane with hydroxyl groups and reduce the occurrence of dot-like image defects. The atom bonded to a Si atom included in the silazane may be at least one selected from a hydrogen atom, a carbon atom, and a Si atom.

Examples of the silazane with which the outer peripheral surface of the conductive substrate is treated include the silazanes represented by General Formulae (S1) to (S3) below.

(S1)

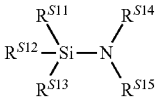

(S2)

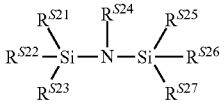

(S3)

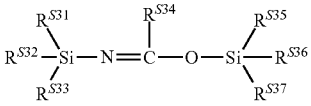

In General Formulae (S1) to (S3) above, $R^{S11}$ to $R^{S15}$, $R^{S21}$ to $R^{S27}$, and $R^{S31}$ to $R^{S37}$ each independently represent a hydrogen atom or a monovalent organic group; and $R^{S14}$ and $R^{S15}$ may be bonded to one another to form a ring.

$R^{S11}$ to $R^{S13}$, $R^{S21}$ to $R^{S23}$, $R^{S25}$ to $R^{S27}$, and $R^{S31}$ to $R^{S33}$ in General Formulae (S1) to (S3) are the same as $R^{S1}$ to $R^{S3}$ in General Formula (A), respectively.

$R^{S21}$ to $R^{S23}$ and $R^{S25}$ to $R^{S27}$ in General Formula (S2) may be the same as or different from each other and are preferably the same as each other, respectively. In other words, the two silyl groups included in the silazane represented by General Formula (S2) may be the same as or different from each other and are preferably the same as each other.

Examples of the monovalent organic groups represented by $R^{S14}$ and $R^{S15}$ in General Formula (S1) include an unsubstituted or substituted alkyl group, an unsubstituted or substituted cycloalkyl group, an unsubstituted or substituted aryl group, and an unsubstituted or substituted alkylcarbonyl group.

Examples of the ring constituted by $R^{S14}$ and $R^{S15}$ that are bonded to each other include an unsubstituted or substituted, nitrogen-containing heterocyclic ring.

Examples of the alkyl groups represented by $R^{S14}$ and $R^{S15}$ are the same as the above-described examples of the alkyl groups represented by $R^{S1}$ to $R^{S3}$.

Examples of a group with which the alkyl groups represented by $R^{S14}$ and $R^{S15}$ may be substituted include a halogen atom, a cycloalkyl group, an aryl group, an alkoxy group, an alkylthio group, an alkylcarbonyl group, and an amino group.

Examples of the halogen atom, the alkoxy group, the alkylthio group, and the amino group with which the alkyl groups may be substituted are the same as the above-described examples of the halogen atom, the alkoxy group, the alkylthio group, and the amino group with which the alkyl groups represented by $R^{S1}$ to $R^{S3}$ may be substituted.

Examples of the cycloalkyl group, the aryl group, and the alkylcarbonyl group with which the alkyl groups may be substituted are the same as the examples of the cycloalkyl groups, the aryl groups, and the alkylcarbonyl groups represented by $R^{S14}$ and $R^{S15}$ which are described below, respectively.

Examples of the cycloalkyl groups represented by $R^{S14}$ and $R^{S15}$ are the same as the above-described examples of the cycloalkyl groups represented by $R^{S1}$ to $R^{S3}$.

Examples of a group with which the cycloalkyl groups represented by $R^{S14}$ and $R^{S15}$ may be substituted include a halogen atom, an alkyl group, an aryl group, an alkoxy group, an alkylthio group, an alkylcarbonyl group, and an amino group.

Examples of the halogen atom, the alkoxy group, the alkylthio group, and the amino group with which the cycloalkyl groups may be substituted are the same as the above-described examples of the halogen atoms, the alkoxy groups, the alkylthio groups, and the amino groups with which the alkyl groups represented by $R^{S1}$ to $R^{S3}$ may be substituted, respectively.

Examples of the alkyl group with which the cycloalkyl groups may be substituted are the same as the above-described examples of the alkyl groups represented by $R^{S14}$ and $R^{S15}$.

Examples of the aryl group and the alkylcarbonyl group with which the cycloalkyl groups may be substituted are the same as the examples of the aryl groups and the alkylcarbonyl groups represented by $R^{S14}$ and $R^{S15}$ which are described below, respectively.

Examples of the aryl groups represented by $R^{S14}$ and $R^{S15}$ are the same as the above-described examples of the aryl groups represented by $R^{S1}$ to $R^{S3}$.

Examples of a group with which the aryl groups represented by $R^{S14}$ and $R^{S15}$ may be substituted include a halogen atom, an alkyl group, a cycloalkyl group, an alkoxy group, an alkylthio group, an alkylcarbonyl group, and an amino group.

Examples of the halogen atom, the alkoxy group, the alkylthio group, and the amino group with which the aryl groups may be substituted are the same as the above-described examples of the halogen atom, the alkoxy group, the alkylthio group, and the amino group with which the alkyl groups represented by $R^{S1}$ to $R^{S3}$ may be substituted, respectively.

Examples of the alkyl group and the cycloalkyl group with which the aryl groups may be substituted are the same as the above-described examples of the alkyl groups and the cycloalkyl groups represented by $R^{S14}$ and $R^{S15}$, respectively.

Examples of the alkylcarbonyl group with which the aryl groups may be substituted are the same as the examples of the alkylcarbonyl groups represented by $R^{S14}$ and $R^{S15}$.

Examples of the alkylcarbonyl groups represented by $R^{S14}$ and $R^{S15}$ include a carbonyl group to which an alkyl group selected from the above-described examples of the alkyl groups represented by $R^{S14}$ and $R^{S15}$ is bonded.

Examples of a group with which the alkylcarbonyl groups represented by $R^{S14}$ and $R^{S15}$ may be substituted include a halogen atom, a cycloalkyl group, an aryl group, an alkoxy group, an alkylthio group, an alkylcarbonyl group, and an amino group.

Examples of the halogen atom, the alkoxy group, the alkylthio group, and the amino group with which the alkylcarbonyl groups may be substituted are the same as the above-described examples of the halogen atoms, the alkoxy groups, the alkylthio groups, and the amino groups represented by $R^{S1}$ to $R^{S3}$, respectively.

Examples of the cycloalkyl group, the aryl group, and the alkylcarbonyl group with which the alkylcarbonyl groups may be substituted are the same as the above-described examples of the cycloalkyl groups, the aryl groups, and the alkylcarbonyl groups represented by $R^{S14}$ and $R^{S15}$, respectively.

Examples of the nitrogen-containing heterocyclic ring constituted by $R^{S14}$ and $R^{S15}$ that are bonded to each other include a nitrogen-containing heterocyclic ring in which the number of atoms constituting the ring (hereinafter, referred to as "ring-constituting atom number") is 3 to 12 and is preferably 3 to 9. Note that the ring-constituting atom number also denotes the number of nitrogen atoms constituting a Si—N bond. The nitrogen-containing heterocyclic ring may further include a hetero atom in addition to the nitrogen atom constituting a Si—N bond. Examples of the hetero atom include a nitrogen atom, an oxygen atom, and a sulfur atom.

Specific examples of the nitrogen-containing heterocyclic ring include an ethylenimine ring, an azacyclobutane ring, a pyrrole ring, a piperidine ring, a hexamethyleneimine ring, an azatropilidene ring, a pyrrolidine ring, an imidazole ring, a pyrazole ring, an imidazoline ring, a morpholine ring, a thiazine ring, an indole ring, an isoindole ring, a benzoimidazole ring, a purine ring, and a carbazole ring.

The nitrogen-containing heterocyclic ring may optionally be substituted. Examples of a group with which the nitrogen-containing heterocyclic ring may be substituted include a halogen atom, an alkyl group, a cycloalkyl group, an aryl group, an alkoxy group, an alkylthio group, an alkylcarbonyl group, and an amino group.

Examples of the halogen atom, the alkoxy group, the alkylthio group, and the amino group with which the nitrogen-containing heterocyclic ring may be substituted are the same as the above-described examples of the halogen atom, the alkoxy group, the alkylthio group, and the amino group with which the alkyl groups represented by $R^{S1}$ to $R^{S3}$ may be substituted, respectively.

Examples of the alkyl group, the cycloalkyl group, the aryl group, and the alkylcarbonyl group with which the nitrogen-containing heterocyclic ring may be substituted are the same as the above-described examples of the alkyl groups, the cycloalkyl groups, the aryl groups, and the alkylcarbonyl groups represented by $R^{S14}$ and $R^{S15}$, respectively.

In order to enhance the reactivity of the silazane with hydroxyl groups present on the surface of the conductive substrate, $R^{S14}$ and $R^{S15}$ in General Formula (S1) are preferably a hydrogen atom, an unsubstituted alkyl group, an alkyl group substituted with a halogen atom, an unsubstituted alkylcarbonyl group, or an alkylcarbonyl group substituted with a halogen atom or form a unsubstituted nitrogen-containing heterocyclic ring by being bonded to each other and are more preferably a hydrogen atom, an unsubstituted alkyl group having 1 to 12 carbon atoms, an alkylcarbonyl group that is a carbonyl group to which an unsubstituted alkyl group having 1 to 12 carbon atoms is bonded, or an alkylcarbonyl group that is a carbonyl group to which a halogen-substituted alkyl group having 1 to 12 carbon atoms is bonded or form an unsubstituted nitrogen-containing heterocyclic ring having a ring constituting atom number of 5 to 9 by being bonded to each other.

When $R^{S14}$ and $R^{S15}$ do not form a ring, $R^{S14}$ and $R^{S15}$ may be the same group or different groups. In such a case, it is preferable that at least one selected from $R^{S14}$ and $R^{S15}$ be a monovalent organic group, and it is more preferable that both $R^{S14}$ and $R^{S15}$ are monovalent organic groups.

Examples of the monovalent organic group represented by $R^{S24}$ in General Formula (S2) include an unsubstituted alkyl group.

Examples of the alkyl group represented by $R^{S24}$ are the same as the above-described examples of the alkyl groups represented by $R^{S1}$ to $R^{S3}$.

$R^{S24}$ in General Formula (S2) is preferably a hydrogen atom or an unsubstituted alkyl group having 1 to 12 carbon atoms and is more preferably a hydrogen atom in order to enhance the reactivity of the silazane with hydroxyl groups present on the surface of the conductive substrate.

Examples of the monovalent organic group represented by $R^{S34}$ in General Formula (S3) include an unsubstituted or substituted alkyl group, an unsubstituted or substituted cycloalkyl group, and an unsubstituted or substituted aryl group.

Examples of the alkyl group represented by $R^{S34}$ are the same as the above-described examples of the alkyl groups represented by $R^{S1}$ to $R^{S3}$.

Examples of a group with which the alkyl group represented by $R^{S34}$ may be substituted include a halogen atom, a cycloalkyl group, an aryl group, an alkoxy group, an alkylthio group, and an amino group.

Examples of the halogen atom, the alkoxy group, the alkylthio group, and the amino group with which the alkyl group may be substituted are the same as the above-described examples of the halogen atom, the alkoxy group, the alkylthio group, and the amino group with which the alkyl groups represented by $R^{S1}$ to $R^{S3}$ may be substituted, respectively.

Examples of the cycloalkyl group and the aryl group with which the alkyl group may be substituted are the same as the examples of the cycloalkyl group and the aryl group represented by $R^{S34}$ which are described below, respectively.

Examples of the cycloalkyl group represented by $R^{S34}$ are the same as the above-described examples of the cycloalkyl groups represented by $R^{S1}$ to $R^{S3}$.

Examples of a group with which the cycloalkyl group represented by $R^{S34}$ may be substituted include a halogen atom, an alkyl group, an aryl group, an alkoxy group, an alkylthio group, and an amino group.

Examples of the halogen atom, the alkoxy group, the alkylthio group, and the amino group with which the cycloalkyl group may be substituted are the same as the above-described examples of the halogen atom, the alkoxy group, the alkylthio group, and the amino group with which the alkyl groups represented by $R^{S1}$ to $R^{S3}$ may be substituted, respectively.

Examples of the alkyl group with which the cycloalkyl group may be substituted are the same as the above-described examples of the alkyl group represented by $R^{S34}$.

Examples of the aryl group with which the cycloalkyl group may be substituted are the same as the examples of the aryl group represented by $R^{S34}$ which are described below.

Examples of the aryl group represented by $R^{S34}$ are the same as the above-described examples of the aryl groups represented by $R^{S1}$ to $R^{S3}$.

Examples of a group with which the aryl group represented by $R^{S34}$ may be substituted include a halogen atom, an alkyl group, a cycloalkyl group, an alkoxy group, an alkylthio group, and an amino group.

Examples of the halogen atom, the alkoxy group, the alkylthio group, and the amino group with which the aryl group may be substituted are the same as the above-described examples of the halogen atom, the alkoxy group, the alkylthio group, and the amino group with which the alkyl groups represented by $R^{S1}$ to $R^{S3}$ may be substituted, respectively.

Examples of the alkyl group and the cycloalkyl group with which the aryl group may be substituted are the same as the above-described examples of the alkyl group and the cycloalkyl group represented by $R^{S34}$, respectively.

$R^{S34}$ in General Formula (S3) is preferably a hydrogen atom, an unsubstituted alkyl group, or a halogen-substituted alkyl group and is more preferably a hydrogen atom or an unsubstituted alkyl group having 1 to 12 carbon atoms in order to enhance the reactivity of the silazane with hydroxyl groups present on the surface of the conductive substrate.

The silazane is preferably a compound represented by any one of General Formulae (S1) to (S3) and is more preferably a compound represented by General Formula (S1) or (S2).

Specific examples of the silazane include, but are not limited to, the following.

S-1

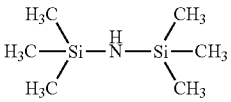

S-2

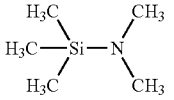

S-3

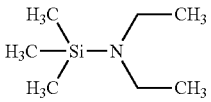

S-4

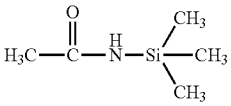

-continued

S-5

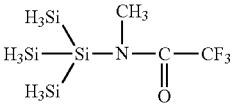

S-6

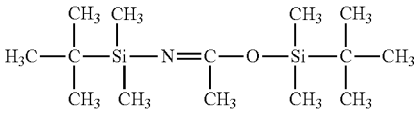

S-7

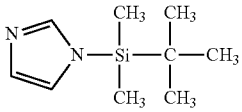

S-8

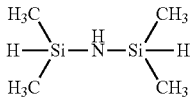

S-9

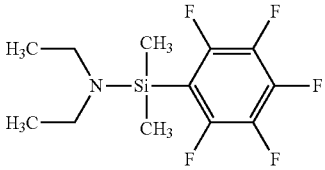

S-10

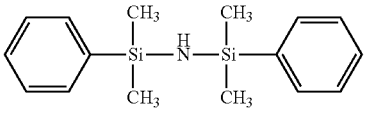

S-11

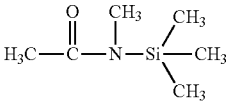

For treating the outer peripheral surface of the pre-silazane-treatment conductive substrate with a silazane, silazane may be used directly or in the form of a liquid mixture prepared by diluting the silazane with a solvent and appropriate additives. Hereinafter, the liquid mixture containing a silazane is referred to as "silazane-containing liquid mixture".

Examples of the solvent included in the silazane-containing liquid mixture include, but are not limited to, hexane, benzene, ether, and toluene.

Examples of the additives included in the silazane-containing liquid mixture include, but are not limited to, catalysts such as trifluoroacetate, hydrogen chloride, and ammonium sulfide.

The content of the silazane in the silazane-containing liquid mixture is not limited and may be, for example, 10% by weight or more and 90% by weight or less.

For treating the outer peripheral surface of the pre-silazane-treatment conductive substrate with a silazane, for example, the pre-silazane-treatment conductive substrate may be dipped in a silazane or a silazane-containing liquid mixture in a dry atmosphere. Alternatively, a silazane or a silazane-containing liquid mixture may be sprayed onto the outer peripheral surface of the pre-silazane-treatment conductive substrate.

In the silazane treatment, the temperature of the silazane or the silazane-containing liquid mixture may be set to, for example, 20° C. or more and 100° C. or less and is preferably set to 30° C. or more and 70° C. or less. The temperature of the silazane or the silazane-containing liquid mixture may be changed depending on the content of the silazane.

The amount of time required by the silazane treatment may be, but not limited to, for example, 1 minute or more and 24 hours or less. The amount of time required by the silazane treatment may be changed depending on the content of the silazane.

Subsequent to the silazane treatment, the silazane-treated conductive substrate may be cleaned with a hydrophobic organic solvent (e.g., hexane, benzene, ether, or toluene) in order to remove the unreacted portion of the silazane and subsequently dried in order to remove the hydrophobic organic solvent.

As described above, hydroxyl (—OH) groups that are present on the outer peripheral surface of the pre-silazane-treatment conductive substrate or hydrogen (—H) atoms included in the hydroxyl groups are replaced with a silyl group in the silazane-treated conductive substrate, which is prepared by treating the outer peripheral surface of the pre-silazane-treatment conductive substrate with a silazane.

Whether the conductive substrate is a silazane-treated conductive substrate can be determined by utilizing infrared absorption. In the case where it is difficult to determine the presence of silyl groups by utilizing infrared absorption, a method in which water contact angle is measured may be readily employed.

An increase in contact angle which occurs while the outer peripheral surface of the conductive substrate is made hydrophobic by the silazane treatment indicates reaction of the hydroxyl (—OH) groups.

As described above, another possible way to replace hydroxyl groups present on the outer peripheral surface of the pre-silazane-treatment conductive substrate with a silyl group is silylation with a silane coupling agent. However, a silane coupling agent has lower reactivity with hydroxyl groups than a silazane. In addition, when a silane coupling agent is decomposed by hydrolysis, hydroxyl groups (i.e., silanol groups) are generated. Consequently, the number of hydroxyl (—OH) groups remaining on the outer peripheral surface of a conductive substrate treated with a silane coupling agent is likely to be large compared with a silazane-treated conductive substrate. In the case where a silane coupling agent is used, alkoxysilyl groups, which are different from silyl groups, are bonded to the outer peripheral surface of the conductive substrate. Thus, whether a conductive substrate is treated with a silazane or by silylation with a silane coupling agent can be determined to some extent by using infrared absorption, gas chromatography, X-ray photoelectron spectroscopy (XPS), or the like.

The conductive substrate may be subjected to a treatment other than the silazane treatment prior to the silazane treatment. In other words, the pre-silazane-treatment conductive substrate may be a conductive substrate that has been subjected to a treatment other than the silazane treatment.

Examples of the other treatment include the roughening treatment, a treatment with an acidic coating liquid, and a boehmite treatment, which are described below.

In particular, the other treatment may be performed prior to the silazane treatment.

The other treatment of the pre-silazane-treatment conductive substrate is described below.

In the case where the electrophotographic photoreceptor is used as a component of a laser printer, the surface of the pre-silazane-treatment conductive substrate may be roughened to an arithmetic average of the roughness profile Ra of 0.04 μm or more and 0.5 μm or less in order to reduce the likelihood of interference fringes being formed when the photoreceptor is irradiated with a laser beam. Performing roughening for preventing the formation of interference fringes may be omitted in the case where a light source that emits incoherent light is used, but may increase the service life of the photoreceptor because it reduces the likelihood of defects being caused due to the irregularities in the surface of the conductive substrate.

For roughening the surface of the conductive substrate, for example, the following methods may be employed: wet honing in which a liquid prepared by suspending an abrasive in water is sprayed to the conductive substrate; centerless grinding in which the conductive substrate is continuously ground by being brought into pressure contact with a rotating grinding wheel; and anodic oxidation.

For roughening the surface of the conductive substrate by anodic oxidation, anodic oxidation is performed in an electrolyte solution by using a conductive substrate made of a metal such as aluminium as an anode in order to form an oxide film on the surface of the conductive substrate. Examples of the electrolyte solution include a sulfuric acid solution and an oxalic acid solution. However, originally, the porous anodic oxide film formed by anodic oxidation is chemically active and susceptible to contamination. Furthermore, the resistivity of the porous anodic oxide film varies greatly depending on the environment. Therefore, a sealing treatment of the porous anodic oxide film, in which micropores formed in the oxide film are closed by cubical expansion caused due to hydration in pressurized steam or boiling water that may contain a salt of a metal such as nickel, may be performed in order to change the oxide film into a hydrous oxide film, which is more stable than an oxide film.

The thickness of the anodic oxide film may be, for example, 0.3 μm or more and 15 μm or less. When the thickness of the anodic oxide film falls within the above range, the injection barrier property of the oxide film may be enhanced. In addition, an increase in the residual potential due to the repeated use may be limited.

The pre-silazane-treatment conductive substrate may be treated with an acidic treatment liquid or subjected to a boehmite treatment.

The treatment of the conductive substrate with an acidic treatment liquid may be performed, for example, in the following manner. An acidic treatment liquid containing phosphoric acid, chromium acid, and hydrofluoric acid is prepared. The contents of the phosphoric acid, the chromium acid, and the hydrofluoric acid in the acidic treatment liquid are, for example, as follows: phosphoric acid: 10% by weight or more and 11% by weight or less; chromium acid: 3% by weight or more and 5% by weight or less; and hydrofluoric acid: 0.5% by weight or more and 2% by weight or less. The total concentration of these acids may be 13.5% by weight or more and 18% by weight or less. The treatment temperature may be, for example, 42° C. or more and 48° C. or less. The thickness of the coating film may be 0.3 μm or more and 15 μm or less.

In the boehmite treatment, for example, the conductive substrate is dipped in pure water having a temperature of 90° C. or more and 100° C. or less for 5 to 60 minutes or brought into contact with steam having a temperature of 90° C. or more and 120° C. or less for 5 to 60 minutes. The thickness of the coating film may be 0.1 μm or more and 5 μm or less. The resulting conductive substrate may optionally be subjected to anodic oxidation with an electrolyte solution having a low coating-film dissolubility, such as adipic acid, boric acid, a boric acid salt, a phosphoric acid salt, a phthalic acid salt, a maleic acid salt, a benzoic acid salt, a tartaric acid salt, or a citric acid salt.

Undercoat Layer

Although not illustrated in the drawings, an undercoat layer may optionally be interposed between the conductive substrate and the photosensitive layer.

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less.

Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume-average diameter of the inorganic particles may be, for example, 50 nm or more and 2,000 nm or less and is preferably 60 nm or more and 1,000 nm or less.

The content of the inorganic particles is preferably, for example, 10% by weight or more and 80% by weight or less and is more preferably 40% by weight or more and 80% by weight or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminate coupling agent, and a surfactant. In particular, a silane coupling agent is preferable and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another silane coupling agent. Examples of the other silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment of the inorganic particles with the surface-treating agent may be performed by any known method. Both dry process and wet process may be employed.

The amount of surface-treating agent used may be, for example, 0.5% by weight or more and 10% by weight or less of the amount of inorganic particles.

The undercoat layer may include an electron accepting compound (i.e., acceptor compound) in addition to the inorganic particles in order to enhance the long-term stability of electrical properties and carrier blocking property.

Examples of the electron accepting compound include the following electron transporting substances: quinones such as chloranil and bromanil; tetracyanoquinodimethanes; fluorenones such as 2,4,7-trinitrofluorenone and 2,4,5,7-tetranitro-9-fluorenone; oxadiazoles such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones such as 3,3',5,5'-tetra-t-butyldiphenoquinone.

In particular, compounds including an anthraquinone structure may be used as an electron accepting compound. Examples of the compound including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron accepting compound included in the undercoat layer may be dispersed in the undercoat layer together with the inorganic particles or deposited on the surfaces of the inorganic particles.

For depositing the electron accepting compound on the surfaces of the inorganic particles, for example, a dry process and a wet process may be employed.

In a dry process, for example, while the inorganic particles are stirred with a mixer or the like capable of producing a large shearing force, the electron accepting compound or a solution prepared by dissolving the electron accepting compound in an organic solvent is added dropwise or sprayed together with dry air or a nitrogen gas to the inorganic particles in order to deposit the electron accepting compound on the surfaces of the inorganic particles. The addition or spraying of the electron accepting compound may be done at a temperature equal to or lower than the boiling point of the solvent used. Subsequent to the addition or spraying of the electron accepting compound, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron accepting compound is added to the resulting dispersion. After the dispersion has been stirred or dispersed, the solvent is removed such that the electron accepting compound is deposited on the surfaces of the inorganic particles. The removal of the solvent may be done by, for example, filtration or distillation. Subsequent to the removal of the solvent, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved. In the wet process, moisture contained in the inorganic particles may be removed prior to the addition of the electron accepting compound. The removal of moisture contained in the inorganic particles may be done by, for example, heating the inorganic particles while being stirred in the solvent or by bringing the moisture to the boil together with the solvent.

The deposition of the electron accepting compound may be done prior or subsequent to the surface treatment of the inorganic particles with the surface-treating agent. Alternatively, the deposition of the electron accepting compound and the surface treatment using the surface-treating agent may be performed at the same time.

The content of the electron accepting compound may be, for example, 0.01% by weight or more and 20% by weight or less and is preferably 0.01% by weight or more and 10% by weight or less of the amount of inorganic particles.

Examples of the binder resin included in the undercoat layer include the following known materials: known high-molecular compounds such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelates; titanium chelates; aluminium chelates; titanium alkoxides; organic titanium compounds; and silane coupling agents.

Other examples of the binder resin included in the undercoat layer include charge transporting resins including a charge transporting group and conductive resins such as polyaniline.

Among the above binder resins, resins that are insoluble in a solvent included in a coating liquid used for forming a layer on the undercoat layer may be used as a binder resin included in the undercoat layer. In particular, resins produced by reacting at least one resin selected from thermosetting resins (e.g., a urea resin, a phenol resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio between the binder resins may be set appropriately.

The undercoat layer may include various additives in order to enhance electrical properties, environmental stability, and image quality.

Examples of the additives include the following known materials: electron transporting pigments such as polycondensed pigments and azo pigments, zirconium chelates, titanium chelates, aluminium chelates, titanium alkoxides, organic titanium compounds, and silane coupling agents. The silane coupling agents, which may be used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine, and polyhydroxy titanium stearate.

Examples of the aluminium chelates include aluminium isopropylate, monobutoxy aluminium diisopropylate, aluminium butyrate, diethyl acetoacetate aluminium diisopropylate, and aluminium tris(ethyl acetoacetate).

The above additives may be used alone. Alternatively, two or more types of the above compounds may be used in a mixture or in the form of a polycondensate.

The undercoat layer may have a Vickers hardness of 35 or more.

In order to reduce the formation of moiré fringes, the surface roughness (i.e., ten-point-average roughness) of the undercoat layer may be controlled to be $1/(4\ n)$ to ½ of the wavelength $\lambda$ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be ground in order to adjust the surface roughness of the undercoat layer. For grinding the surface of the undercoat layer, buffing, sand blasting, wet honing, grinding, and the like may be performed.

The method for forming the undercoat layer is not limited, and known methods may be employed. For example, a coating film is formed using an undercoat-layer forming coating liquid prepared by mixing the above-described components with a solvent, and the coating film is dried and, as needed, heated.

Examples of the solvent used for preparing the undercoat-layer forming coating liquid include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat-layer forming coating liquid, for example, known equipment such as a roll mill, a ball mill, a vibrating ball mill, an Attritor, a sand mill, a colloid mill, and a paint shaker may be used.

For coating the conductive substrate with the undercoat-layer forming coating liquid, for example, common methods such as blade coating, wire bar coating, spray coating, dip coating, bead coating, air knife coating, and curtain coating may be employed.

The thickness of the undercoat layer is preferably set to, for example, 15 μm or more and is more preferably set to 18 μm or more and 50 μm or less.

Intermediate Layer

Although not illustrated in the drawings, an intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound that may be included in the intermediate layer include organometallic compounds containing a metal atom such as a zirconium atom, a titanium atom, an aluminium atom, a manganese atom, or a silicon atom.

The above compounds that may be included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

The method for forming the intermediate layer is not limited, and known methods may be employed. For example, a coating film is formed using an intermediate-layer forming coating liquid prepared by mixing the above-described components with a solvent, and the coating film is dried and, as needed, heated.

For forming the intermediate layer, common coating methods such as dip coating, push coating, wire bar coating, spray coating, blade coating, knife coating, and curtain coating may be employed.

The thickness of the intermediate layer may be set to, for example, 0.1 μm or more and 3 μm or less. It is possible to use the intermediate layer as an undercoat layer. Single-Layer Photosensitive Layer The single-layer photosensitive layer includes a binder resin, a charge generating material, an electron transporting material, and a hole transporting material. The single-layer photosensitive layer may optionally include other additives.

Binder Resin

Examples of the binder resin include, but are not limited to, a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. The above binder resins may be used alone or in a mixture of two or more.

Among the above binder resins, in particular, for example, a polycarbonate resin having a viscosity-average molecular weight of 30,000 or more and 80,000 or less may be used from the viewpoint of the formability of the photosensitive layer.

The content of the binder resin may be, for example, 35% by weight or more and 60% by weight or less, is preferably 50% by weight or more and 60% by weight or less, and is further preferably 53% by weight or more and 60% by weight or less of the total solid content of the photosensitive layer.

Charge Generating Material

Examples of the charge generating material include azo pigments such as bisazo and trisazo; annulated aromatic pigments such as dibromoanthanthrone; perylene pigments; pyrrolopyrrole pigments; phthalocyanine pigments; zinc oxide; and trigonal selenium.

Among the above charge generating materials, a metal phthalocyanine pigment or a nonmetal phthalocyanine pigment may be used in consideration of exposure to a laser beam in the near-infrared region. Specific examples of such charge generating materials include hydroxygallium phthalocyanine, chlorogallium phthalocyanine, dichloro tin phthalocyanine, and titanyl phthalocyanine.

Among the above charge generating materials, annulated aromatic pigments such as dibromoanthanthrone; thioindigo pigments; porphyrazines; zinc oxide; trigonal selenium; and bisazo pigments may be used in consideration of exposure to a laser beam in the near-ultraviolet region.

That is, an inorganic pigment may be used as a charge generating material in the case where, for example, the wavelength of light emitted by the light source used for exposure is 380 nm or more and 500 nm or less, and a metal and a nonmetal phthalocyanine pigment may be used as a charge generating material in the case where the wavelength of light emitted by the light source used for exposure is 700 nm or more and 800 nm or less.

In this exemplary embodiment, the charge generating material may be at least one pigment selected from a hydroxygallium phthalocyanine pigment and a chlorogallium phthalocyanine pigment.

The above pigments may be used alone or in combination as needed as a charge generating material. In particular, the charge generating material may be a hydroxygallium phthalocyanine pigment in order to enhance the sensitivity of the photoreceptor and reduce the occurrence of dot-like image defects.

The type of the hydroxygallium phthalocyanine pigment is not limited. In order to enhance the sensitivity of the photoreceptor and reduce formation of color spots on images, a Type-V hydroxygallium phthalocyanine pigment may be used.

In particular, the hydroxygallium phthalocyanine pigment may be, for example, a hydroxygallium phthalocyanine pigment having a maximum peak wavelength at 810 nm or more and 839 nm or less in a spectral absorption spectrum that covers the range of 600 nm or more and 900 nm or less, because such hydroxygallium phthalocyanine pigment is capable of being dispersed at a higher degree. That is, when such hydroxygallium phthalocyanine pigment is used as a material of the electrophotographic photoreceptor, excellent dispersibility, sufficiently high sensitivity, sufficiently high chargeability, and a sufficiently high dark decay characteristic are likely to be achieved.

The hydroxygallium phthalocyanine pigment having a maximum peak wavelength at 810 nm or more and 839 nm or less may have an average particle diameter that falls within a specific range and a BET specific surface area that falls within a specific range. Specifically, the average particle diameter of such a hydroxygallium phthalocyanine pigment is preferably 0.20 μm or less and is more preferably 0.01 μm or more and 0.15 μm or less, and the BET specific surface area of such a hydroxygallium phthalocyanine pigment is preferably 45 $m^2/g$ or more, is more preferably 50 $m^2/g$ or more, and is particularly preferably 55 $m^2/g$ or more and 120 $m^2/g$ or less. The average particle diameter of the hydroxygallium phthalocyanine pigment is the volume-average particle diameter (i.e., d50 average particle diameter) of the hydroxygallium phthalocyanine pigment which is measured with a laser diffraction/scattering particle size distribution analyzer "LA-700" produced by HORIBA, Ltd. The BET specific surface area of the hydroxygallium phthalocyanine pigment is measured by a nitrogen purge method with a BET specific surface area analyzer "Flowsorb II2300" produced by Shimadzu Corporation.

If the average particle diameter of the hydroxygallium phthalocyanine pigment is larger than 0.20 μm or the specific surface area of the hydroxygallium phthalocyanine pigment is less than 45 $m^2/g$, the size of the pigment particles may be excessively large or the pigment particles may form aggregates. This increases the occurrence of degradation of the properties such as dispersibility, sensitivity, chargeability, and a dark decay characteristic and, as a result, the defects of image quality may be increased.

The maximum particle diameter (i.e., maximum primary-particle diameter) of the hydroxygallium phthalocyanine pigment is preferably 1.2 μm or less, is more preferably 1.0 μm or less, and is further preferably 0.3 μm or less. If the maximum particle diameter of the hydroxygallium phthalocyanine pigment exceeds the above range, the occurrence of black spots may be increased.

The hydroxygallium phthalocyanine pigment may have an average particle diameter of 0.2 μm or less, a maximum particle diameter of 1.2 μm or less, and a specific surface area of 45 $m^2/g$ or more in order to reduce the inconsistencies in density which may occur due to exposure of the photoreceptor to a fluorescent lamp or the like.

The hydroxygallium phthalocyanine pigment may be a Type-V hydroxygallium phthalocyanine pigment having a diffraction peak at, at least, Bragg angles (20±0.2°) of 7.3°, 16.0°, 24.9°, and 28.0° in an X-ray diffraction spectrum measured with the CuKα radiation.

Although the type of the chlorogallium phthalocyanine pigment is not limited, the chlorogallium phthalocyanine pigment may have a diffraction peak at Bragg angles (2θ±) 0.2° of 7.4°, 16.6°, 25.5°, and 28.3°. Such a chlorogallium phthalocyanine pigment serves as a material of the electrophotographic photoreceptor material which has excellent sensitivity.

The suitable maximum peak wavelength in a spectral absorption spectrum, average particle diameter, maximum particle diameter, and specific surface area of the chlorogallium phthalocyanine pigment are the same as those of the hydroxygallium phthalocyanine pigment.

The content of the charge generating material may be, for example, 1% by weight or more and 5% by weight or less and is preferably 1.2% by weight or more and 4.5% by weight or less of the total solid content of the photosensitive layer.

Electron Transporting Material

Examples of the electron transporting material include, but are not limited to, the following electron transporting compounds: quinones such as p-benzoquinone, chloranil, bromanil, and anthraquinone; tetracyanoquinodimethane compounds; fluorenones such as 2,4,7-trinitrofluorenone; fluorenes such as dicyanomethylenefluorene; xanthones; benzophenones; cyanovinyl compounds; and ethylenes. The above electron transporting materials may be used alone or in a mixture of two or more.

The electron transporting material is preferably at least one selected from compounds including a fluorene skeleton such as fluorenones and fluorenes and quinones, is more preferably at least one selected from fluorene derivatives including a dicyanomethylene group and diphenoquinones, and is further preferably at least one selected from the electron transporting materials represented by General Formulae (1) and (2) below from the viewpoint of the mobility of charge.

The electron transporting material represented by General Formula (1) is described below.

(1)

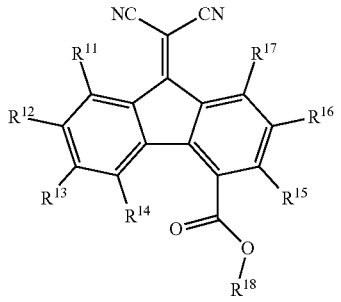

In General Formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, a $-L^{19}-O-R^{20}$ group, an aryl group, or an aralkyl group, where L is an alkylene group and $R^{20}$ is an alkyl group.

Examples of the halogen atoms represented by $R^{11}$ to $R^{17}$ in General Formula (1) include a fluorine atom, a chlorine atom, a bromine atom, and an iodine atom.

Examples of the alkyl groups represented by $R^{11}$ to $R^{17}$ in General Formula (1) include linear and branched alkyl groups having 1 to 4 carbon atoms and preferably 1 to 3 carbon atoms, such as a methyl group, an ethyl group, an n-propyl group, an isopropyl group, an n-butyl group, and an isobutyl group.

Examples of the alkoxy groups represented by $R^{11}$ to $R^{17}$ in General Formula (1) include alkoxy groups having 1 to 4 carbon atoms and preferably 1 to 3 carbon atoms, such as a methoxy group, an ethoxy group, a propoxy group, and a butoxy group.

Examples of the aryl groups represented by $R^{11}$ to $R^{17}$ in General Formula (1) include a phenyl group and a tolyl group. Among the aryl groups represented by $R^{11}$ to $R^{17}$, in particular, a phenyl group may be used.

Examples of the aralkyl groups represented by $R^{11}$ to $R^{17}$ in General Formula (1) are the same as the examples of the aralkyl group represented by $R^{18}$ which are described below, such as a benzyl group, a phenethyl group, and a phenylpropyl group.

Examples of the alkyl group represented by $R^{18}$ in General Formula (1) include a linear alkyl group having 1 to 12 carbon atoms and preferably 5 to 10 carbon atoms and a branched alkyl group having 3 to 10 carbon atoms and preferably 5 to 10 carbon atoms.

Examples of the linear alkyl group having 1 to 12 carbon atoms include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, and an n-dodecyl group.

Examples of the branched alkyl group having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the $-L^{19}-O-R^{20}$ group represented by $R^{18}$ in General Formula (1), $L^{19}$ represents an alkylene group, and $R^{20}$ represents an alkyl group.

Examples of the alkylene group represented by $L^{19}$ include linear and branched alkylene groups having 1 to 12 carbon atoms, such as a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the alkyl group represented by $R^{20}$ are the same as the above-described examples of the alkyl groups represented by $R^{11}$ to $R^{17}$.

Examples of the aryl group represented by $R^{18}$ in General Formula (1) include a phenyl group, a methylphenyl group, a dimethylphenyl group, and an ethylphenyl group.

The aryl group represented by $R^{18}$ may be an aryl group substituted with an alkyl group, that is, an alkyl-substituted aryl group, from the viewpoint of solubility. Examples of the alkyl group with which an aryl group may be substituted to form the alkyl-substituted aryl group are the same as the above-described examples of the alkyl groups represented by $R^{11}$ to $R^{17}$.

Examples of the aralkyl group represented by $R^{18}$ in General Formula (1) include a group represented by $-R^{18A}-Ar$, where $R^{18A}$ is an alkylene group and Ar is an aryl group.

Examples of the alkylene group represented by $R^{18A}$ include linear and branched alkylene groups having 1 to 12 carbon atoms, such as a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

Specific examples of the aralkyl group represented by $R^{18}$ in General Formula (1) include a benzyl group, a methylbenzyl group, a dimethylbenzyl group, a phenylethyl group, a methylphenylethyl group, a phenylpropyl group, and a phenylbutyl group.

Among electron transporting materials represented by General Formula (1), an electron transporting material in which $R^{18}$ is a branched alkyl group having 5 to 10 carbon atoms or aralkyl group may be used in order to enhance the sensitivity of the photoreceptor and reduce the occurrence of color spots. In particular, an electron transporting material in which $R^{11}$ to $R^{17}$ are each independently a hydrogen atom, a halogen atom, or an alkyl group and $R^{18}$ is a branched alkyl group having 5 to 10 carbon atoms or aralkyl group may be used.

Specific examples of the electron transporting material represented by General Formula (1) include, but are not limited to, the following exemplified compounds. Hereinafter, the following exemplified compounds are numbered "exemplified compound (1-[Number])". Specifically, for example, the exemplified compound (15) is numbered "exemplified compound (1-15)".

| Exemplified compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| (1) | H | H | H | H | H | H | H | $-n-C_4H_9$ |
| (2) | H | H | H | H | H | H | H | $-n-C_8H_{17}$ |
| (3) | H | H | H | H | H | H | H | $-CH_2-CH(C_2H_5)-C_4H_9$ |
| (4) | H | H | H | H | H | H | H | 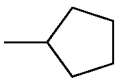 |
| (5) | H | H | H | H | H | H | H | 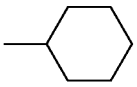 |
| (6) | H | H | H | H | H | H | H | 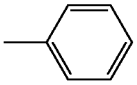 |
| (7) | H | H | H | H | H | H | H | 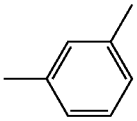 |
| (8) | H | H | H | H | H | H | H | 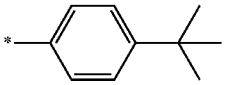 |
| (9) | H | H | H | H | H | H | H | 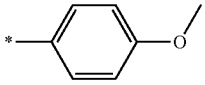 |

-continued

| Exemplified compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| (10) | H | H | H | H | H | H | H | 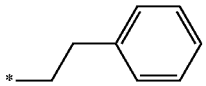 |
| (11) | H | t-Bu | H | H | H | t-Bu | H | -n-$C_4H_9$ |
| (12) | H | t-Bu | H | H | H | t-Bu | H | 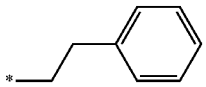 |
| (13) | H | Cl | H | H | H | Cl | H | -n-$C_8H_{17}$ |
| (14) | H | H | H | H | H | H | H | -n-$C_7H_{15}$ |
| (15) | H | H | H | H | H | H | H | -n-$C_5H_{11}$ |
| (16) | H | H | H | H | H | H | H | -n-$C_{10}H_{21}$ |
| (17) | Cl | Cl | Cl | Cl | Cl | Cl | Cl | -n-$C_7H_{15}$ |
| (18) | Cl | Cl | H | Cl | H | Cl | H | -n-$C_7H_{15}$ |
| (19) | Me | Me | Me | Me | Me | Me | Me | -n-$C_7H_{15}$ |
| (20) | n-Bu | n-Bu | n-Bu | n-Bu | n-Bu | n-Bu | n-Bu | -n-$C_7H_{15}$ |
| (21) | MeO | H | MeO | H | MeO | H | MeO | -n-$C_8H_{17}$ |
| (22) | Ph | Ph | Ph | Ph | Ph | Ph | Ph | -n-$C_8H_{17}$ |
| (23) | H | H | H | H | H | H | H | -n-$C_{11}H_{23}$ |
| (24) | H | H | H | H | H | H | H | -n-$C_9H_{19}$ |
| (25) | H | H | H | H | H | H | H | -n-$C_{12}H_{25}$ |
| (26) | H | H | H | H | H | H | H | —$CH_2$—Ph |
| (27) | H | H | H | H | H | H | H | —$C_2H_5$—O—$CH_3$ |

The abbreviations used for describing the above-described exemplified compounds stand for the following.

*: Position at which the group is bonded to the oxygen atom n-Bu: n-Butyl group t-Bu: t-Butyl group Cl: Chlorine atom Me: Methyl group MeO: Methoxy group Ph: Phenyl group The electron transporting material represented by General Formula (2) is described below.

(2)

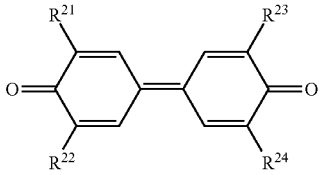

In General Formula (2), $R^{21}$, $R^{22}$, $R^{23}$, and $R^{24}$ each independently represent a hydrogen atom, an alkyl group, an alkoxy group, a halogen atom, or a phenyl group.

Examples of the alkyl groups represented by $R^{21}$ to $R^{24}$ in General Formula (2) include linear and branched alkyl groups having 1 to 6 carbon atoms, such as a methyl group, an ethyl group, an n-propyl group, an isopropyl group, an n-butyl group, an isobutyl group, a tert-butyl group, a pentyl group, and a hexyl group.

The alkyl groups represented by $R^{21}$ to $R^{24}$ may be substituted with a group. Examples of the group with which the alkyl groups may be substituted include a cycloalkyl group and a fluorine-substituted alkyl group.

Examples of the alkoxy groups represented by $R^{21}$ to $R^{24}$ in General Formula (2) include an alkoxy group having 1 to 6 carbon atoms, such as a methoxy group, an ethoxy group, a propoxy group, and a butoxy group.

Examples of the halogen atoms represented by $R^{21}$ to $R^{24}$ in General Formula (2) include a chlorine atom, an iodine atom, a bromine atom, and a fluorine atom.

The phenyl groups represented by $R^{21}$ to $R^{24}$ in General Formula (2) may be substituted with a group. Examples of the group with which the phenyl groups may be substituted include an alkyl group having 1 to 6 carbon atoms, an alkoxy group having 1 to 6 carbon atoms, and a biphenyl group.

Among electron transporting materials represented by General Formula (2), an electron transporting material in which at least one and preferably three or more selected from $R^{21}$ to $R^{24}$ are branched alkyl groups having 4 carbon atoms may be used in order to enhance the sensitivity of the photoreceptor and reduce the occurrence of color spots.

Specific examples of the electron transporting materials represented by General Formula (2) include, but are not limited to, the following exemplified compounds. Hereinafter, the following exemplified compounds are numbered "exemplified compound (2-[Number])". Specifically, for example, the exemplified compound (2) is numbered "exemplified compound (2-2)".

(1)

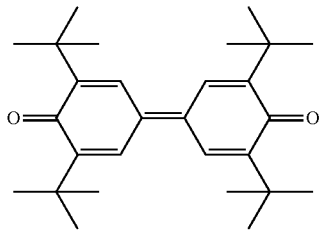

-continued (2)

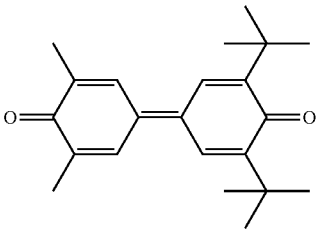

(3)

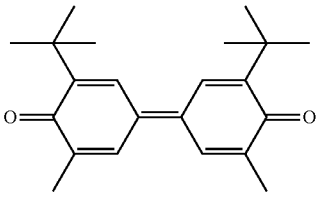

Specific examples of the electron transporting material also include, in addition to the electron transporting materials represented by General Formulae (1) and (2), the compounds represented by Structural Formulae (ET-A) to (ET-E) below. The other electron transporting materials described below may be used in combination with at least one selected from electron transporting materials represented by General Formulae (1) and (2).

ET-A

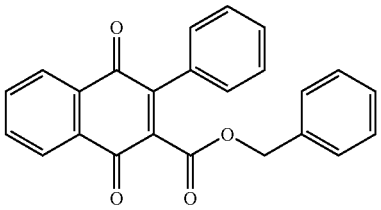

ET-B

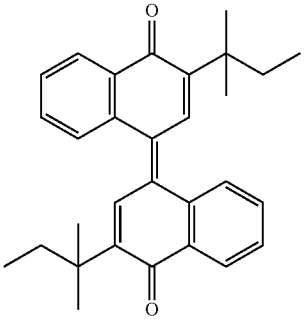

-continued

ET-C

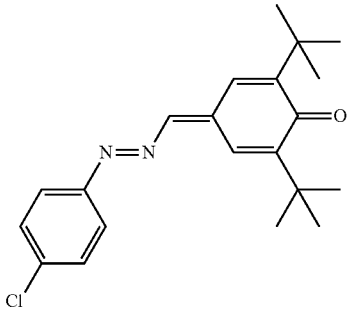

ET-D

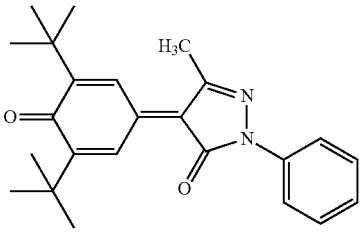

ET-E

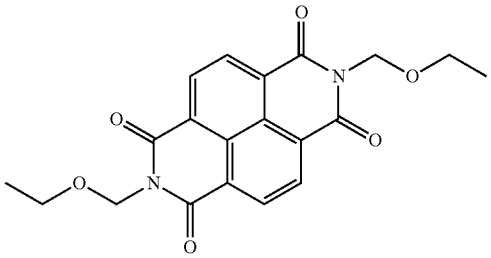

The total content of the electron transporting materials in the photosensitive layer is preferably 2% by weight or more and 30% by weight or less and is more preferably 5% by weight or more and 20% by weight or less in terms of solid content. Setting the content of the electron transporting materials to be within the above range enables a photoreceptor having good electrical properties and a good charge retention capability to be produced.

Hole Transporting Material

Examples of the hole transporting material include, but are not limited to, triarylamines, benzidines, arylalkanes, aryl-substituted ethylenes, stilbenes, anthracenes, and hydrazones. The above hole transporting materials may be used alone or in a mixture of two or more.

The hole transporting material preferably includes a triarylamine, more preferably includes a triarylamine having a butadiene structure, and further preferably includes the hole transporting material represented by General Formula (3) below from the viewpoint of the mobility of charge.

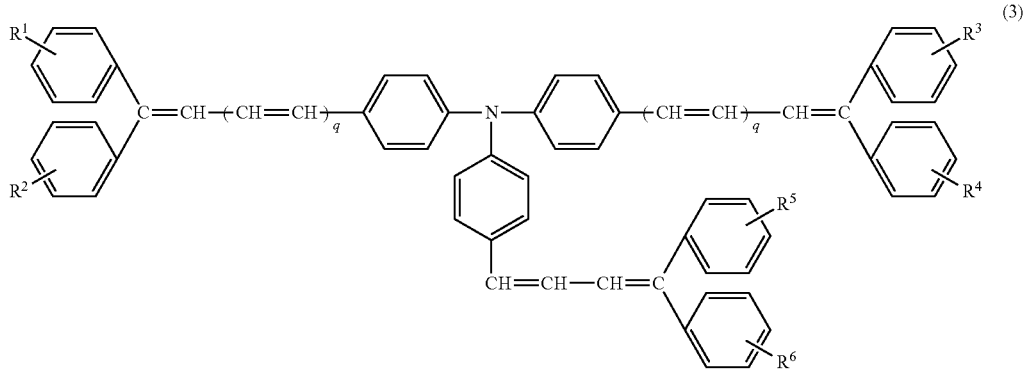

(3)

In General Formula (3), $R^1$, $R^2$, $R^3$, $R^4$, $R^5$, and $R^6$ each independently represent a hydrogen atom, a lower-alkyl group, an alkoxy group, a phenoxy group, a halogen atom, or a phenyl group unsubstituted or substituted with a group selected from a lower-alkyl group, a lower-alkoxy group, and a halogen atom; and p and q are each independently 0 or 1.

Examples of the lower-alkyl groups represented by $R^1$ to $R^6$ in General Formula (3) include linear and branched alkyl groups having 1 to 4 carbon atoms, such as a methyl group, an ethyl group, an n-propyl group, an isopropyl group, an n-butyl group, and an isobutyl group.

Among the above lower-alkyl groups, in particular, a methyl group and an ethyl group may be used.

Examples of the alkoxy groups represented by $R^1$ to $R^6$ in General Formula (3) include alkoxy groups having 1 to 4 carbon atoms, such as a methoxy group, an ethoxy group, a propoxy group, and a butoxy group.

Examples of the halogen atoms represented by $R^1$ to $R^6$ in General Formula (3) include a fluorine atom, a chlorine atom, a bromine atom, and an iodine atom.

Examples of the phenyl groups represented by $R^1$ to $R^6$ in General Formula (3) include an unsubstituted phenyl group; lower-alkyl-substituted phenyl groups such as a p-tolyl group and a 2,4-dimethylphenyl group; lower-alkoxy-substituted phenyl groups such as a p-methoxyphenyl group; and halogen-substituted phenyl groups such as a p-chlorophenyl group.

Examples of a group with which the phenyl groups may be substituted include the above-described examples of the lower-alkyl groups, the lower-alkoxy groups, and the halogen atoms represented by $R^1$ to $R^6$.

Among hole transporting materials represented by General Formula (3), a hole transporting material in which both p and q are 1 may be used in order to enhance the sensitivity of the photoreceptor and reduce the occurrence of color spots. In particular, a hole transporting material in which $R^1$ to $R^6$ are each independently a hydrogen atom, a lower-alkyl group, or an alkoxy group and both p and q are 1 may be used.

Specific examples of the hole transporting material represented by General Formula (3) include, but are not limited to, the following exemplified compounds. Hereinafter, the following exemplified compounds are numbered "exemplified compound (3-[Number])". Specifically, for example, the exemplified compound (15) is numbered "exemplified compound (3-15)".

| Exemplified compound | p | q | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |
| 8 | 1 | 1 | 4-Me0 | H | 4-Me0 | H | 4-Me0 | H |
| 9 | 1 | 1 | H | H | H | H | 4-Me0 | 4-Me0 |
| 10 | 1 | 1 | 4-Me0 | 4-Me0 | 4-Me0 | 4-Me0 | 4-Me0 | 4-Me0 |
| 11 | 1 | 1 | 4-Me0 | H | 4-Me0 | H | 4-Me0 | 4-Me0 |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-Me0 | 4-Me | 4-Me0 | 4-Me | 4-Me0 |
| 18 | 1 | 1 | 3-Me | 4-Me0 | 3-Me | 4-Me0 | 3-Me | 4-Me0 |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |

-continued

| Exemplified compound | p | q | $R^1$ | $R^2$ | $R^3$ | $R^4$ | $R^5$ | $R^6$ |
|---|---|---|---|---|---|---|---|---|
| 27 | 1 | 0 | 4-Me | H | H | H | 4-Me | H |
| 28 | 1 | 0 | 4-Me0 | H | H | H | 4-Me0 | H |
| 29 | 1 | 0 | H | H | 4-Me0 | 4-Me0 | H | H |
| 30 | 1 | 0 | 4-Me0 | 4-Me0 | 4-Me0 | 4-Me0 | 4-Me0 | 4-Me0 |
| 31 | 1 | 0 | 4-Me0 | H | 4-Me0 | H | 4-Me0 | 4-Me0 |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-Me0 | 4-Me | 4-Me0 | 4-Me | 4-Me0 |
| 38 | 1 | 0 | 3-Me | 4-Me0 | 3-Me | 4-Me0 | 3-Me | 4-Me0 |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-Me0 | H | 4-Me0 | H | H | H |
| 49 | 0 | 0 | H | H | H | H | 4-Me0 | 4-Me0 |
| 50 | 0 | 0 | 4-Me0 | 4-Me0 | 4-Me0 | 4-Me0 | 4-Me0 | 4-Me0 |
| 51 | 0 | 0 | 4-Me0 | H | 4-Me0 | H | 4-Me0 | 4-Me0 |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-Me0 | 4-Me | 4-Me0 | 4-Me | 4-Me0 |
| 58 | 0 | 0 | 3-Me | 4-Me0 | 3-Me | 4-Me0 | 3-Me | 4-Me0 |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |
| 62 | 1 | 1 | 4-Ph0 | 4-Ph0 | 4-Ph0 | 4-Ph0 | 4-Ph0 | 4-Ph0 |
| 63 | 1 | 1 | H | 4-Me | H | 4-Me | H | 4-Me |
| 64 | 1 | 1 | $4\text{-}C_6H_5$ | $4\text{-}C_6H_5$ | $4\text{-}C_6H_5$ | $4\text{-}C_6H_5$ | $4\text{-}C_6H_5$ | $4\text{-}C_6H_5$ |

The abbreviations used for describing the above-described exemplified compounds stand for the following.

4-Me: Methyl group bonded to the phenyl group at the 4-position

3-Me: Methyl group bonded to the phenyl group at the 3-position

4-Cl: Chlorine atom bonded to the phenyl group at the 4-position

4-MeO: Methoxy group bonded to the phenyl group at the 4-position

4-F: Fluorine atom bonded to the phenyl group at the 4-position

4-Pr: Propyl group bonded to the phenyl group at the 4-position

4-PhO: Phenoxy group bonded to the phenyl group at the 4-position

Specific examples of the hole transporting material also include, in addition to the hole transporting material represented by General Formula (3), the compounds represented by General Formulae (B-1) to (B-3) below.

(B-1)

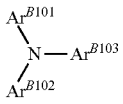

In General Formula (B-1), $Ar^{B101}$, $Ar^{B102}$, and $Ar^{B103}$ each independently represent an unsubstituted or substituted aryl group, a $—C_6H_4—C(R^{B104})=C(R^{B105})(R^{B106})$ group, or a $—C_6H_4—CH=CH—CH=C(R^{B107})(R^{B108})$ group, where $R^{B104}$, $R^{B105}$, $R^{B106}$, $R^{B107}$, and $R^{B108}$ are each independently a hydrogen atom, an unsubstituted or substituted alkyl group, or an unsubstituted or substituted aryl group.

Examples of a group with which the above groups may be substituted include a halogen atom, an alkyl group having 1 to 5 carbon atoms, an alkoxy group having 1 to 5 carbon atoms, and an amino group substituted with an alkyl group having 1 to 3 carbon atoms.

(B-2)

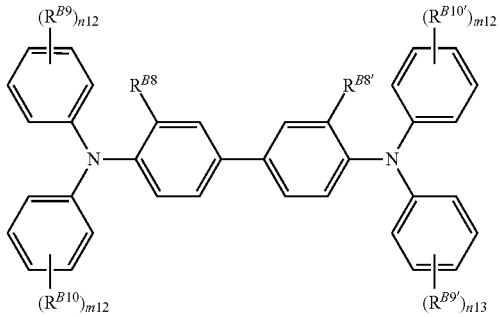

In General Formula (B-2), $R^{B8}$ and $R^{B8'}$ may be the same as or different from each other and each independently represent a hydrogen atom, a halogen atom, an alkyl group having 1 to 5 carbon atoms, or an alkoxy group having 1 to 5 carbon atoms; $R^{B9}$, $R^{B9'}$, $R^{B10}$, and $R^{B10'}$ may be the same as or different from one another and each independently represent a halogen atom, an alkyl group having 1 to 5 carbon atoms, an alkoxy group having 1 to 5 carbon atoms, an amino group substituted with an alkyl group having 1 or 2 carbon atoms, an unsubstituted or substituted aryl group, a —C($R^{B11}$)═C($R^{B12}$)($R^{B13}$) group, or a —CH═CH—CH═C($R^{B14}$)($R^{B15}$) group, where $R^{B11}$ to $R^{B15}$ are each independently a hydrogen atom, an unsubstituted or substituted alkyl group, or an unsubstituted or substituted aryl group; and m12, m13, n12, and n13 each independently represent an integer of 0 to 2.

(B-3)

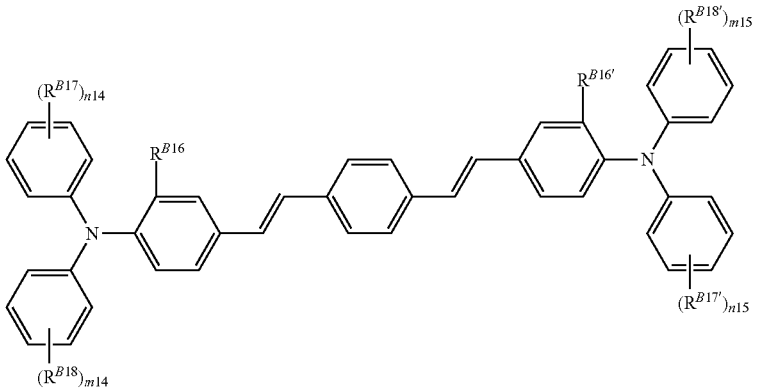

In General Formula (B-3), $R^{B16}$ and $R^{B16'}$ may be the same as or different from each other and each independently represent a hydrogen atom, a halogen atom, an alkyl group having 1 to 5 carbon atoms, or an alkoxy group having 1 to 5 carbon atoms; $R^{B17}$, $R^{B17'}$, $R^{B18}$, and $R^{B18'}$ may be the same as or different from each other and each independently represent a halogen atom, an alkyl group having 1 to 5 carbon atoms, an alkoxy group having 1 to 5 carbon atoms, an amino group substituted with an alkyl group having 1 or 2 carbon atoms, an unsubstituted or substituted aryl group, a —C($R^{B19}$)═C($R^{B20}$)($R^{B21}$) group, or a —CH═CH—CH═C($R^{B22}$)($R^{B23}$) group, where $R^{B19}$ to $R^{B23}$ are each independently a hydrogen atom, an unsubstituted or substituted alkyl group, or an unsubstituted or substituted aryl group; and m14, m15, n14, and n15 are each independently an integer of 0 to 2.

Among the compounds represented by General Formulae (B-1) to (B-3), in particular, a compound represented by General Formula (B-1) which includes the —$C_6H_4$—CH═CH—CH═C($R^{B107}$)($R^{B108}$) group and a compound represented by General Formula (B-2) which includes the —CH═CH—CH═C($R^{B14}$) ($R^{B15}$) group may be used.

Specific examples of the compounds represented by General Formulae (B-1) to (B-3) include the following compounds.

HT-1

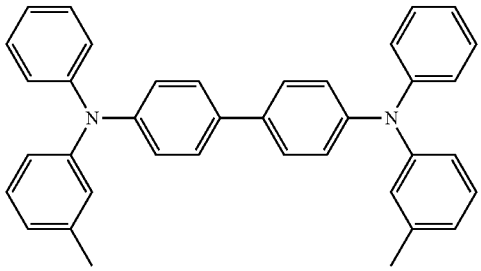

HT-2

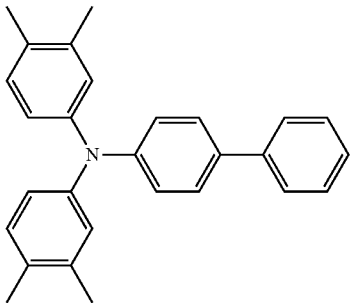

-continued
HT-3
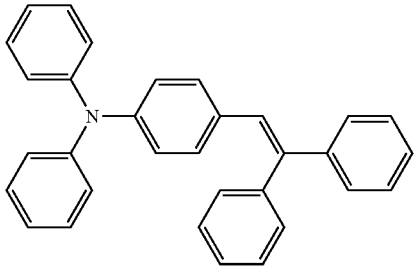
HT-4
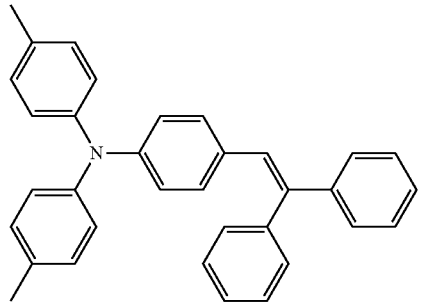
HT-5
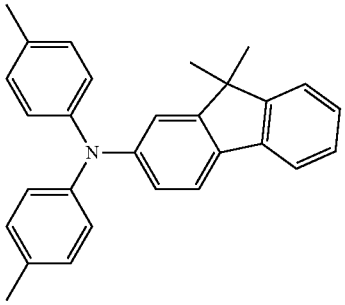
HT-6
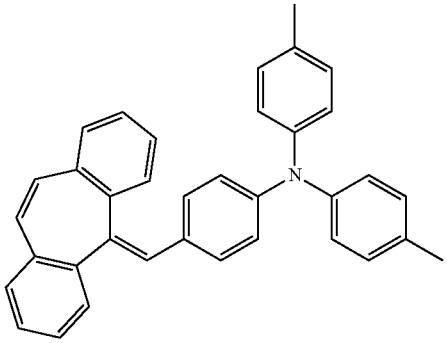
HT-7
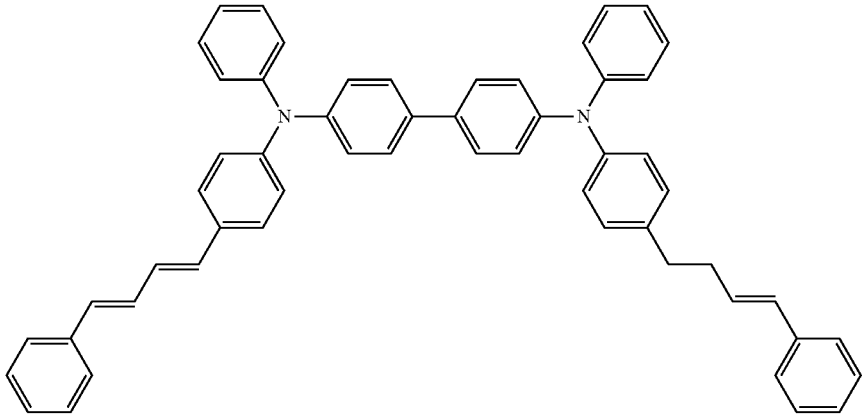
HT-8
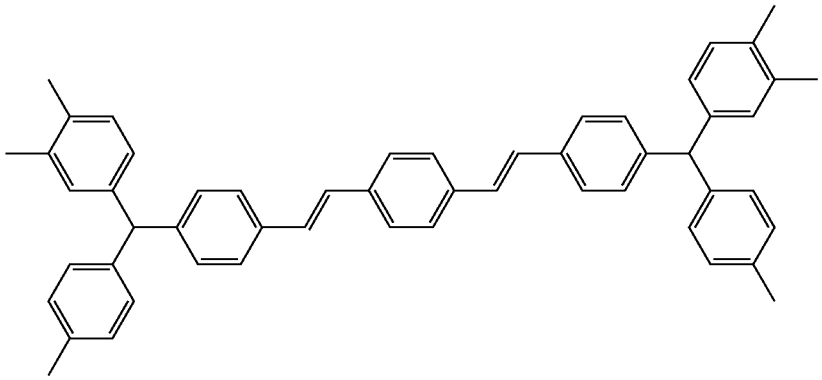

-continued

HT-9

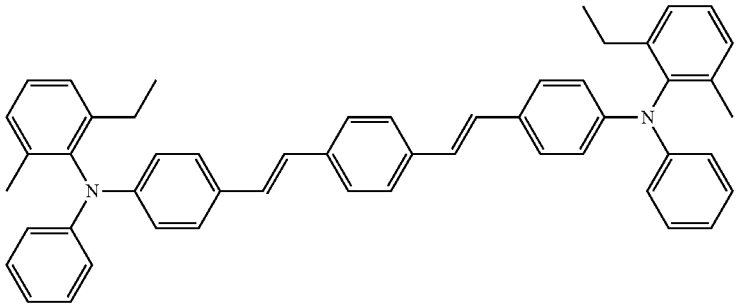

HT-10

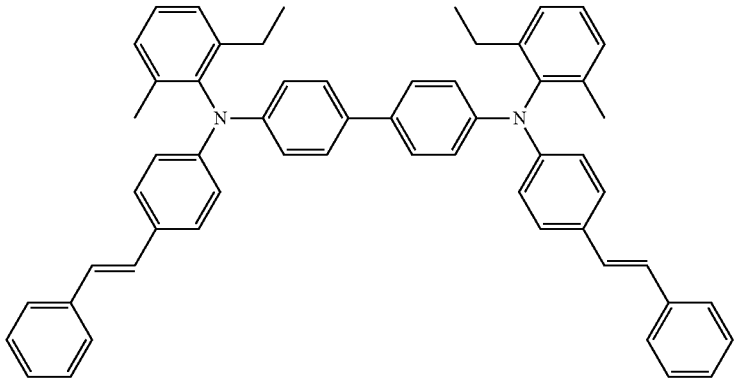

HT-11

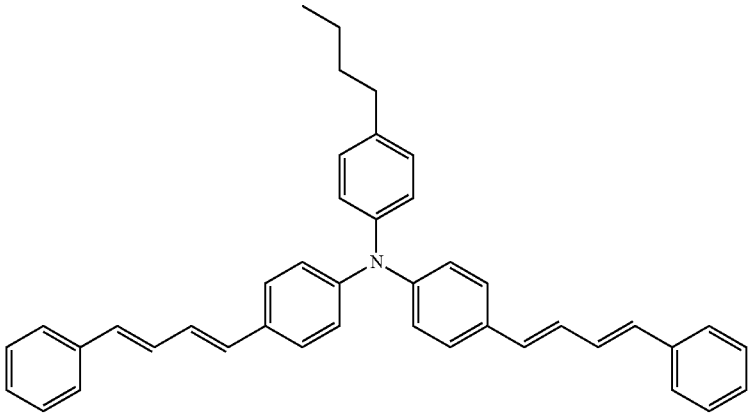

The content of the hole transporting material may be, for example, 10% by weight or more and 40% by weight or less and is preferably 20% by weight or more and 35% by weight or less of the total solid content of the photosensitive layer.

Note that, in the case where two or more hole transporting materials are used in combination, the term "content of the hole transporting material" used herein refers to the total content of the hole transporting materials.

Ratio between Hole Transporting Material and Electron Transporting Material

The weight ratio of the hole transporting material to the electron transporting material, that is, [hole transporting material]/[electron transporting material] is preferably 50/50 or more and 90/10 or less and is more preferably 60/40 or more and 80/20 or less.

Note that, in the case where other charge transporting materials are used in combination, the term "weight ratio of the hole transporting material to the electron transporting material" used herein refers to the ratio of the total weight of the hole transporting materials to the total weight of the electron transporting materials.

Other Additives

The single-layer photosensitive layer may optionally include other known additives such as a surfactant, an antioxidant, a light stabilizer, and a heat stabilizer. In the case where the single-layer photosensitive layer serves as a surface layer, the single-layer photosensitive layer may include fluorine resin particles, a silicone oil, and the like.

Formation of Single-Layer Photosensitive Layer

The single-layer photosensitive layer may be formed using a photosensitive-layer forming coating liquid prepared by mixing the above-described components with a solvent.

Examples of the solvent include the following common organic solvents: aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. The above solvents may be used alone or in a mixture of two or more.

For dispersing particles of the charge generating material and the like in the photosensitive-layer forming coating liquid, media dispersing machines such as a ball mill, a vibration ball mill, an Attritor, a sand mill, and a horizontal sand mill; and medialess dispersing machines such as a stirrer, an ultrasonic disperser, a roll mill, and a high-pressure homogenizer may be used. Examples of the high-pressure homogenizer include an impact-type homogenizer in which a dispersion is brought into collision with a liquid or a wall under a high-pressure condition in order to perform dispersion and a pass-through-type homogenizer in which a dispersion is passed through a very thin channel under a high-pressure condition in order to perform dispersion.

For applying the photosensitive-layer forming coating liquid on the conductive substrate or the like, for example, dip coating, push coating, wire bar coating, spray coating, blade coating, knife coating, and curtain coating may be employed.

The thickness of the single-layer photosensitive layer is preferably 5 μm or more and 60 μm or less, is more preferably 5 μm or more and 50 μm or less, and is further preferably 10 μm or more and 40 μm or less.

Other Layers

As described above, the photoreceptor according to this exemplary embodiment may optionally include other layers. An example of the other layers is a protection layer that is disposed on the photosensitive layer and serves as a surface layer. The protection layer is provided in order to, for example, reduce the chemical change of the photosensitive layer which may occur during charging and increase the mechanical strength of the photosensitive layer. Therefore, the protection layer may be a layer composed of a cured film (i.e., crosslinked film). Examples of such a layer include the layers described in 1) and 2) below.

1) A layer composed of a film formed by curing a composition including a reactive-group-containing, charge transporting material, which includes a reactive group and a charge transporting skeleton in the same molecule, that is, a layer including a polymer or a crosslinked product of the reactive-group-containing, charge transporting material.

2) A layer composed of a film formed by curing a composition including a nonreactive, charge transporting material and a reactive-group-containing, non-charge-transporting material, which does not include a charge transporting skeleton and includes a reactive group, that is, a layer including a polymer or a crosslinked product of the nonreactive, charge transporting material with the reactive-group-containing, non-charge-transporting material.

Examples of the reactive group included in the reactive-group-containing, charge transporting material include the following known reactive groups: a chain-polymerization group; an epoxy group; a —OH group; a —OR group, where R is an alkyl group; a $—NH_2$ group; a —SH group; a —COOH group; and a $—SiR^{Q1}_{3-Qn}(OR^{Q2})_{Qn}$ group, where $R^{Q1}$ represents a hydrogen atom, an alkyl group, or an unsubstituted or substituted aryl group, $R^{Q2}$ represents a hydrogen atom, an alkyl group, or a trialkylsilyl group, and Qn is an integer of 1 to 3.

The type of the chain-polymerization group is not limited, and any functional group capable of inducing radical polymerization may be used. Examples of such a functional group include functional groups including at least a carbon double bond. Specific examples of the functional groups include functional groups including at least one selected from a vinyl group, a vinylether group, a vinylthioether group, a vinylphenyl group, a styryl group, an acryloyl group, a methacryloyl group, and derivatives of the above groups. In particular, a chain-polymerization group including at least one selected from a vinyl group, a vinylphenyl group, a styryl group, an acryloyl group, a methacryloyl group, and derivatives of the above groups may be used, because such a chain-polymerization group has high reactivity.

The charge transporting skeleton included in the reactive-group-containing, charge transporting material is not limited, and any charge transporting skeleton having a known structure commonly used in electrophotographic photoreceptors may be used. Examples of such a charge transporting skeleton include skeletons that are derived from nitrogen-containing, hole transporting compounds such as triarylamines, benzidines, and hydrazones and conjugated with a nitrogen atom. Among the above skeletons, in particular, a triarylamine skeleton may be used.

The above-described reactive-group-containing, charge transporting material including a reactive group and a charge transporting skeleton, nonreactive, charge transporting material, and reactive-group-containing, non-charge-transporting material may be selected from common materials.

The protection layer may optionally include other known additives.

The method for forming the protection layer is not limited, and known formation methods may be used. For example, a coating film is formed using a protection-layer forming coating liquid prepared by mixing the above-described components in a solvent, subsequently dried, and, as needed, caused to cure by, for example, being heated.

Examples of the solvent used for preparing the protection-layer forming coating liquid include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvent such as isopropyl alcohol and butanol. The above solvents may be used alone or in a mixture of two or more.

The protection-layer forming coating liquid may be prepared without using a solvent.

For applying the protection-layer forming coating liquid on the photosensitive layer, the following common methods may be employed: dip coating, push coating, wire bar coating, spray coating, blade coating, knife coating, curtain coating, and the like.

The thickness of the protection layer is preferably, for example, 1 μm or more and 20 μm or less and is more preferably 2 μm or more and 10 μm or less.

Separated-Function Photosensitive Layer

The separated-function photosensitive layer includes, for example, the conductive substrate, a charge generating layer, and a charge transporting layer that are stacked on top of one another in this order.

Charge Generating Layer

The charge generating layer included in the separated-function photosensitive layer includes, for example, a charge generating material and a binder resin. The charge generating layer may be formed by vapor deposition of the charge generating material.

The charge generating material and the binder resin are the same as the charge generating material and the binder resin included in the above-described single-layer photosensitive layer, respectively. The method for forming the charge generating layer is the same as the method for forming the single-layer photosensitive layer.

The weight ratio between the charge generating material and the binder resin is preferably 10:1 to 1:10.

The thickness of the charge generating layer is preferably, for example, 0.1 μm or more and 5.0 μm or less and is more preferably 0.2 μm or more and 2.0 μm or less.

Charge Transporting Layer

The charge transporting layer included in the separated-function photosensitive layer includes, for example, a charge transporting material and a binder resin. The charge transporting layer may include a macromolecular charge transporting material.

The details of the charge transporting material are the same as those of the hole transporting material and the electron transporting material included in the above-described single-layer photosensitive layer. The method for forming the charge transporting layer is the same as the method for forming the single-layer photosensitive layer.

The weight ratio between the charge transporting material and the binder resin is preferably 10:1 to 1:5.

The thickness of the charge transporting layer is preferably, for example, 5 μm or more and 50 μm or less and is more preferably 10 μm or more and 30 μm or less.

Image Forming Apparatus and Process Cartridge

An image forming apparatus according to an exemplary embodiment includes an electrophotographic photoreceptor, a charging unit that charges the surface of the electrophotographic photoreceptor, an electrostatic-latent-image forming unit that forms an electrostatic latent image on the charged surface of the electrophotographic photoreceptor, a developing unit that develops the electrostatic latent image formed on the surface of the electrophotographic photoreceptor with a developer including a toner in order to form a toner image, and a transfer unit that transfers the toner image onto the surface of a recording medium. The electrophotographic photoreceptor is the electrophotographic photoreceptor according to the above-described exemplary embodiment.

The image forming apparatus according to this exemplary embodiment may be implemented as any of the following known image forming apparatuses: an image forming apparatus that includes a fixing unit that fixes a toner image transferred onto the surface of a recording medium; a direct-transfer image forming apparatus that directly transfers a toner image formed on the surface of an electrophotographic photoreceptor onto the surface of a recording medium; an intermediate-transfer image forming apparatus that transfers a toner image formed on the surface of an electrophotographic photoreceptor onto the surface of an intermediate transfer body (this process is referred to as "first transfer") and further transfers the toner image transferred onto the surface of the intermediate transfer body onto the surface of a recording medium (this process is referred to as "second transfer"); an image forming apparatus that includes a cleaning unit that cleans the surface of an electrophotographic photoreceptor which has not yet been charged after a toner image has been transferred; an image forming apparatus that includes a charge eliminating unit that irradiates, with charge elimination light, the surface of an electrophotographic photoreceptor which has not yet been charged after a toner image has been transferred in order to eliminate charge; and an image forming apparatus that includes an electrophotographic-photoreceptor heating member that heats an electrophotographic photoreceptor in order to lower the relative temperature of the electrophotographic photoreceptor.

In the intermediate-transfer image forming apparatus, the transfer unit includes, for example, an intermediate transfer body onto which a toner image is transferred, a first transfer unit that transfers a toner image formed on the surface of an electrophotographic photoreceptor onto the surface of the intermediate transfer body (first transfer), and a second transfer unit that transfers the toner image transferred onto the surface of the intermediate transfer body onto the surface of a recording medium (second transfer).

The image forming apparatus according to this exemplary embodiment may be a dry-developing image forming apparatus or a wet-developing image forming apparatus, which develops images with a liquid developer.

In the image forming apparatus according to this exemplary embodiment, for example, a portion including the electrophotographic photoreceptor may have a cartridge structure, that is, may be a process cartridge, which is detachably attachable to the image forming apparatus. The process cartridge may include, for example, the electrophotographic photoreceptor according to the above-described exemplary embodiment. The process cartridge may further include, for example, at least one component selected from a charging unit, an electrostatic-latent-image forming unit, a developing unit, and a transfer unit.

An example of the image forming apparatus according to this exemplary embodiment is described below. However, the image forming apparatus according to this exemplary embodiment is not limited to this. Hereinafter, only the components illustrated in the drawings are described, and the descriptions of the other components are omitted.

Figure 3:
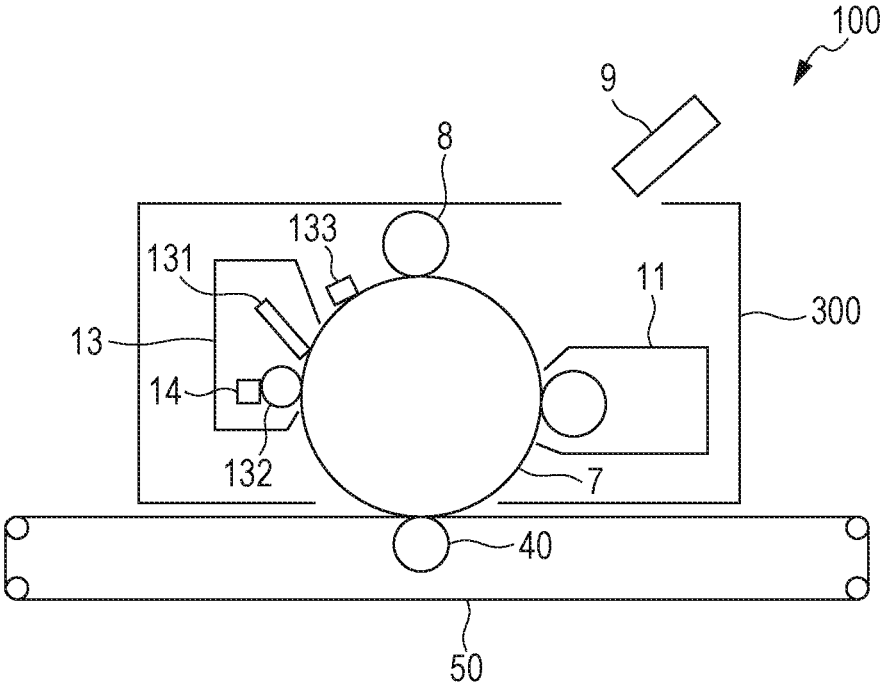
FIG. 3 is a schematic diagram illustrating an example of an image forming apparatus according to an exemplary embodiment.

FIG. 3 schematically illustrates an example of the image forming apparatus according to this exemplary embodiment.

As illustrated in FIG. 3, an image forming apparatus 100 according to this exemplary embodiment includes a process cartridge 300 including an electrophotographic photoreceptor 7, an exposure device 9 (an example of the electrostatic-latent-image forming unit), a transfer device 40 (i.e., first transfer device), and an intermediate transfer body 50. In the image forming apparatus 100, the exposure device 9 is arranged such that the electrophotographic photoreceptor 7 is exposed to light emitted by the exposure device 9 through an aperture formed in the process cartridge 300; the transfer device 40 is arranged so as to face the electrophotographic photoreceptor 7 with the intermediate transfer body 50 interposed therebetween; and the intermediate transfer body 50 is arranged such that part of the intermediate transfer body 50 comes into contact with the electrophotographic photoreceptor 7. Although not illustrated in the drawing, the image forming apparatus 100 also includes a second transfer device that transfers a toner image transferred to the intermediate transfer body 50 to a recording medium such as paper. In the image forming apparatus 100, the intermediate transfer body 50, the transfer device 40 (i.e., first transfer device), and the second transfer device (not shown) correspond to an example of the transfer unit.

The process cartridge 300 illustrated in FIG. 3 includes the electrophotographic photoreceptor 7, a charging device 8 (an example of the charging unit), a developing device 11 (an example of the developing unit), and a cleaning device 13 (an example of the cleaning unit), which are integrally supported inside a housing. The cleaning device 13 includes a cleaning blade 131 (an example of the cleaning member), which is arranged to come into contact with the surface of the electrophotographic photoreceptor 7. The form of the cleaning member is not limited to the cleaning blade 131 and may be, for example, a conductive or insulating fibrous member. The conductive or insulating fibrous member may be used alone or in combination with the cleaning blade 131.

The image forming apparatus illustrated in FIG. 3 includes a roller-like, fibrous member 132 with which a lubricant 14 is fed onto the surface of the electrophotographic photoreceptor 7 and a flat-brush-like, fibrous member 133 that assists cleaning. However, the image forming apparatus illustrated in FIG. 3 is merely an example, and the cleaning members 132 and 133 are optional.

The components of the image forming apparatus according to this exemplary embodiment are each described below.

Charging Device

The charging device 8 may be, for example, a contact charger including a conductive or semiconductive charging roller, charging brush, charging film, charging rubber blade, charging tube, or the like. Known chargers such as a noncontact roller charger and a scorotron and corotron that utilize corona discharge may also be used.

Exposure Device

The exposure device 9 may be, for example, an optical device with which the surface of the electrophotographic photoreceptor 7 can be exposed to light emitted by a semiconductor laser, an LED, a liquid-crystal shutter, or the like in a predetermined image pattern. The wavelength of the light source is set to fall within the range of the spectral sensitivity of the electrophotographic photoreceptor. Although common semiconductor lasers have an oscillation wavelength in the vicinity of 780 nm, that is, the near-infrared region, a semiconductor laser that may be used as a light source is not limited to such semiconductor lasers; semiconductor lasers having an oscillation wavelength of about 600 to 700 nm and blue semiconductor lasers having an oscillation wavelength of 400 nm or more and 450 nm or less may also be used. For forming color images, surface-emitting lasers capable of emitting multi beam may be used as a light source.

Developing Device

The developing device 11 may be, for example, a common developing device that develops latent images with a developer in a contacting or noncontacting manner. The type of the developing device 11 is not limited and may be selected depending on the purpose. Examples of the developing device include known developers capable of depositing a one- or two-component developer on an electrophotographic photoreceptor 7 with a brush, a roller, or the like. In particular, a developing device including a developing roller on which a developer is deposited may be used.

The developer included in the developing device 11 may be a one-component developer containing only a toner or a two-component developer containing a toner and a carrier. The developer may be magnetic or nonmagnetic. Known developers may be used as a developer included in the developing device 11.

Cleaning Device

The cleaning device 13 may be, for example, a cleaning-blade-type cleaning device including a cleaning blade 131.

The type of the cleaning device 13 is not limited to the cleaning-blade-type cleaning device, and a fur-brush-cleaning-type cleaning device and a cleaning device that performs cleaning and development at the same time may also be used.

Transfer Device

The transfer device 40 may be, for example, any of the following known transfer chargers: contact transfer chargers including a belt, a roller, a film, a rubber blade, or the like; and transfer chargers such as a scorotron and a corotron which utilize corona discharge.

Intermediate Transfer Body

The intermediate transfer body 50 may be, for example, a belt-like intermediate transfer body, that is, an intermediate transfer belt, including polyimide, polyamide-imide, polycarbonate, polyarylate, polyester, a rubber, or the like that is made semiconductive. The intermediate transfer body is not limited to a belt-like intermediate transfer body and may be a drum-like intermediate transfer body.

Figure 4:
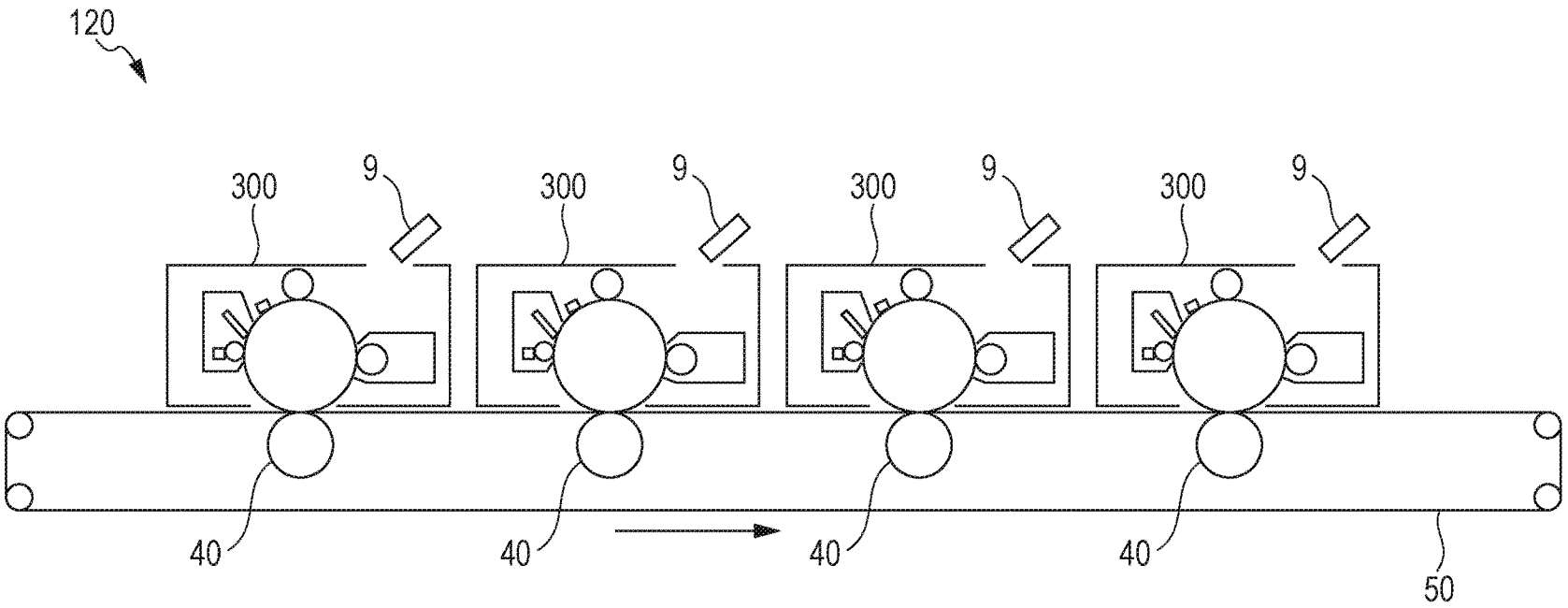
FIG. 4 is a schematic diagram illustrating another example of an image forming apparatus according to an exemplary embodiment.

FIG. 4 schematically illustrates another example of the image forming apparatus according to this exemplary embodiment.

An image forming apparatus 120 illustrated in FIG. 4 is a tandem, multi-color image forming apparatus including four process cartridges 300. In the image forming apparatus 120, the four process cartridges 300 are arranged in parallel to one another on an intermediate transfer body 50, and one electrophotographic photoreceptor is used for one color. The image forming apparatus 120 has the same structure as that of the image forming apparatus 100 except that the image forming apparatus 120 is tandem.

The structure of the image forming apparatus according to this exemplary embodiment is not limited to the structures described above. For example, a first charge-eliminating device may optionally be disposed at a position on the periphery of the electrophotographic photoreceptor 7 which is downstream of the transfer device 40 and upstream of the cleaning device 13 in the direction of rotation of the electrophotographic photoreceptor 7, the first charge-eliminating device causing the polarity of a toner that remains on the electrophotographic photoreceptor 7 to be uniform in order to enable easy removal of the remaining toner with a cleaning brush. A second charge-eliminating device may be disposed at a position on the periphery of the electrophotographic photoreceptor 7 which is downstream of the cleaning device 13 and upstream of the charging device 8 in the direction of rotation of the electrophotographic photoreceptor 7, the second charge-eliminating device eliminating charge present on the surface of the electrophotographic photoreceptor 7.

The structure of the image forming apparatus according to this exemplary embodiment is not limited to the above-described structures, and any image forming apparatus having a common structure may be used. For example, the structure of a direct-transfer image forming apparatus in which a toner image formed on the electrophotographic photoreceptor 7 is transferred directly to a recording medium may be employed.

EXAMPLES

The exemplary embodiments of the invention are described with reference to Examples below. However, the invention is not limited by Examples below.

Conductive Substrate

Preparation of Conductive Substrate 1

An aluminium substrate, that is, a pre-silazane-treatment conductive substrate composed of aluminium, having a diameter of 30 mm and a length of 244 mm is dipped in hexamethyldisilazane (i.e., silazane, exemplified compound S-1) at 25° C. for 3 minutes. The conductive substrate treated with the silazane, that is, the silazane-treated conductive substrate, is cleaned with hexane and subsequently air-dried at 25° C. for 1 hour to form a conductive substrate 1.

Preparation of Conductive Substrate 2

An aluminium substrate, that is, a pre-silazane-treatment conductive substrate composed of aluminium, having a diameter of 30 mm and a length of 244 mm is dipped in a liquid mixture (i.e., silazane-containing liquid mixture) containing hexamethyldisilazane (i.e., silazane, exemplified compound S-1) and toluene at a weight ratio of 1:9 at 50° C. for 10 minutes. The conductive substrate treated with the silazane, that is, the silazane-treated conductive substrate, is cleaned with hexane and subsequently air-dried at 25° C. for 1 hour to form a conductive substrate 2.

Preparation of Conductive Substrate 3

An aluminium substrate, that is, a pre-silazane-treatment conductive substrate composed of aluminium, having a diameter of 30 mm and a length of 244 mm is dipped in a liquid mixture (i.e., silazane-containing liquid mixture) containing N-methyl-N-trimethylsilylacetoamide (i.e., silazane, exemplified compound S-11) and toluene at a weight ratio of 1:9 at 30° C. for 5 hours. The conductive substrate treated with the silazane, that is, the silazane-treated conductive substrate, is cleaned with hexane and subsequently air-dried at 25° C. for 1 hour to form a conductive substrate 3.

Preparation of Conductive Substrate 4

An aluminium substrate, that is, a pre-silazane-treatment conductive substrate composed of aluminium, having a diameter of 30 mm and a length of 244 mm is dipped in a liquid mixture containing N-phenyl-3-aminopropyltrimethoxysilane, toluene, and acetic acid at a weight ratio of 1:9:0.01 at 60° C. for 2 hours. The conductive substrate treated with the silane coupling agent is cleaned with hexane and subsequently air-dried at 25° C. for 1 hour to form a conductive substrate 4.

Preparation of Conductive Substrate 5

An aluminium substrate, that is, a pre-silazane-treatment conductive substrate composed of aluminium, having a diameter of 30 mm and a length of 244 mm is dipped in ion-exchange water having a temperature of 50° C. for 10 minutes to form a conductive substrate 5.

Measurement of Conductive Substrate

The water contact angles of the conductive substrates 1 to 5 are measured.

Specifically, distilled water is dropped onto the surface of each conductive substrate at room temperature (25° C.), and, after a lapse of 10 seconds, the contact angle of the resulting droplets on the surface of the conductive substrate is measured with a contact angle meter "CA-X" produced by Kyowa Interface Science Co., Ltd.

Table 1 summarizes the results.

TABLE 1

| Conductive substrate | Treating agent | Measurement results (Unit: degrees) |
|---|---|---|
| 1 | Silazane S-1 | 84 |
| 2 | Silazane S-1 (Silazane-containing liquid mixture) | 83 |

TABLE 1-continued

| Conductive substrate | Treating agent | Measurement results (Unit: degrees) |
|---|---|---|
| 3 | Silazane S-11 (Silazane-containing liquid mixture) | 82 |
| 4 | Silane coupling agent N-phenyl-3-aminopropyltrimethoxysilane | 76 |
| 5 | Ion-exchange water at 50° C. | 73 |

Formation of Single-Layer Photosensitive Layer

A mixture of 1.5 parts by weight of a hydroxygallium phthalocyanine used as a charge generating material, 49 parts by weight of a copolymerized polycarbonate resin (viscosity-average molecular weight: 50,000) represented by Formula (P) below, which served as a binder resin, 250 parts by weight of tetrahydrofuran, and 20 parts by weight of toluene is dispersed for 3 hours with a sand mill including glass beads having a diameter of 1 mm. Subsequently, the glass beads are removed from the resulting mixture by filtration. Thus, a dispersion is prepared.

The hydroxygallium phthalocyanine used has diffraction peaks at, at least, Bragg angles (2θ±0.2°) of 7.3°, 16.0°, 24.9°, and 28.0° in an X-ray diffraction spectrum measured with the Cukα radiation.

The number denoting each structural unit in Formula (P) below refers to the content (i.e., molar ratio) of the structural unit.

(P)

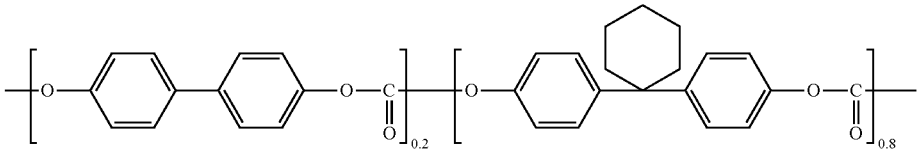

To the dispersion, 30 parts by weight of the specific one of the hole transporting materials described in Table 2, 11 parts by weight of the specific one of the electron transporting materials described in Table 2, and 0.001 parts by weight of a silicone oil "KP340" produced by Shin-Etsu Chemical Co., Ltd. are added. The resulting mixture is stirred through the night, that is, 12 hours, to form a photosensitive-layer forming coating liquid.

The photosensitive-layer forming coating liquids are applied to the respective conductive substrates by dip coating as described in Table 2. The deposited coating liquids are dried at 130° C. for 1 hour to form single-layer photosensitive layers having a thickness of 22 μm. Thus, photoreceptors are prepared.

Evaluation of Photoreceptor

Evaluation of Dot-like Image Defects

Using each of the photoreceptors, a 20%-halftone image is formed on 6,000 sheets with a "HL-2360D" produced by Brother Industries, Ltd. at a room temperature of 30° C. and a humidity of 85%. After a lapse of 10 hours, a 20%-halftone image is formed on another 10 sheets. The image formed on the tenth of the 10 sheets after the lapse of 10 hours is visually inspected for the presence of color spots in accordance with the following criteria. Table 2 summarizes the results.

A: Color spots are absent

B: 9 or less color spots are present and acceptable from the viewpoint of image quality C: 10 or more color spots are present, which might interfere with the use of the photoreceptor.

TABLE 2

| Example | Photoreceptor | Conductive substrate | Electron transporting material | Hole transporting material | Evaluation results |
|---|---|---|---|---|---|
| Example 1 | Photoreceptor 1 | 1 | 1-2 | 3-1 | A |
| Example 2 | Photoreceptor 2 | 2 | 1-3 | 3-1 | A |
| Example 3 | Photoreceptor 3 | 3 | 1-5 | 3-1 | A |
| Example 4 | Photoreceptor 4 | 1 | 1-3 | HT-1 | A |
| Example 5 | Photoreceptor 5 | 1 | 1-5 | HT-1 | B |
| Example 6 | Photoreceptor 6 | 2 | 2-1 | HT-4 | B |
| Example 7 | Photoreceptor 7 | 3 | 2-2 | HT-4 | B |
| Comparative example 1 | Comparative Photoreceptor 1 | 5 | 1-2 | 3-1 | C |
| Comparative example 2 | Comparative Photoreceptor 2 | 5 | 1-3 | HT-4 | C |
| Comparative example 3 | Comparative Photoreceptor 3 | 5 | 2-2 | 3-1 | C |
| Comparative example 4 | Comparative Photoreceptor 4 | 4 | 1-2 | 3-1 | C |

The above results confirm that, with the photoreceptors prepared in Examples, the occurrence of dot-like image defects is reduced compared with the cases where the comparative photoreceptors prepared in Comparative Examples are used.

The abbreviations and the like used in Table 2 stand for the following:

1-2: Exemplified compound (1-2) of the electron transporting material represented by General Formula (1)

1-3: Exemplified compound (1-3) of the electron transporting material represented by General Formula (1)

1-5: Exemplified compound (1-5) of the electron transporting material represented by General Formula (1)

2-1: Exemplified compound (2-1) of the electron transporting material represented by General Formula (2)

2-2: Exemplified compound (2-2) of the electron transporting material represented by General Formula (2)

3-1: Exemplified compound (3-1) of the hole transporting material represented by General Formula (3)

HT-1: Exemplified compound (HT-1) of the compound represented by General Formula (B-2)

HT-4: Exemplified compound (HT-4) of the compound represented by General Formula (B-1)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate including an outer peripheral surface directly treated with a silazane; and a photosensitive layer on the outer peripheral surface of the conductive substrate, the photosensitive layer including a charge generating material and a charge transporting material.

2. The electrophotographic photoreceptor according to claim 1, wherein a surface of the conductive substrate includes a structure represented by Formula (A), (A)

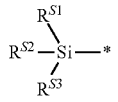

where $R^{S1}$ to $R^{S3}$ each independently represent a hydrogen atom or a monovalent organic group; and * represents a position at which the structure is bonded to the outer peripheral surface of the conductive substrate.

3. The electrophotographic photoreceptor according to claim 2, wherein $R^{S1}$ to $R^{S3}$ in Formula (A) are at least one selected from an unsubstituted or substituted alkyl group, an unsubstituted or substituted cycloalkyl group, an unsubstituted or substituted aryl group, and an unsubstituted or substituted silyl group.

4. The electrophotographic photoreceptor according to claim 2, wherein the structure represented by Formula (A) is at least one selected from the group consisting of structures A-1 to A-6 below,

A-1

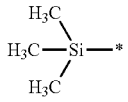

A-2

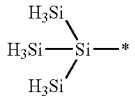

A-3

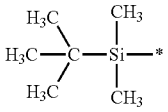

A-4

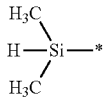

A-5

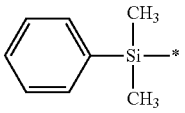

A-6

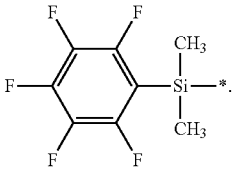

5. The electrophotographic photoreceptor according to claim 2, wherein the conductive substrate includes aluminium or an aluminium alloy.

6. The electrophotographic photoreceptor according to claim 1, wherein the conductive substrate includes aluminium or an aluminium alloy.

7. The electrophotographic photoreceptor according to claim 1, wherein the photosensitive layer is a single-layer photosensitive layer including a binder resin, the charge generating material, and the charge transporting material, the charge transporting material including a hole transporting material and an electron transporting material.

8. The electrophotographic photoreceptor according to claim 7, wherein the electron transporting material includes at least one selected from an electron transporting material represented by Formula (1) and an electron transporting material represented by Formula (2), (1)

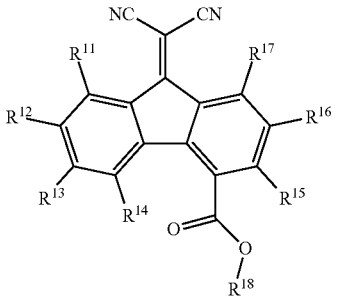

where $R^{11}$, $R^{12}$, $R^{13}$, $R^{14}$, $R^{15}$, $R^{16}$, $R^{17}$ each independently represent a hydrogen atom, a halogen atom, an alkyl group, an alkoxy group, an aryl group, or an aralkyl group; and $R^{18}$ represents an alkyl group, a $-L^{19}-O-R^{20}$ group, an aryl group, or an aralkyl group, $L^{19}$ being an alkylene group and $R^{20}$ being an alkyl group, (2)

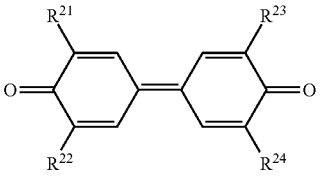

where $R^{21}$, $R^{22}$, $R^{23}$, and $R^{24}$ each independently represent a hydrogen atom, an alkyl group, an alkoxy group, a halogen atom, or a phenyl group.

9. The electrophotographic photoreceptor according to claim 7, wherein the hole transporting material includes a hole transporting material represented by Formula (3), (3)

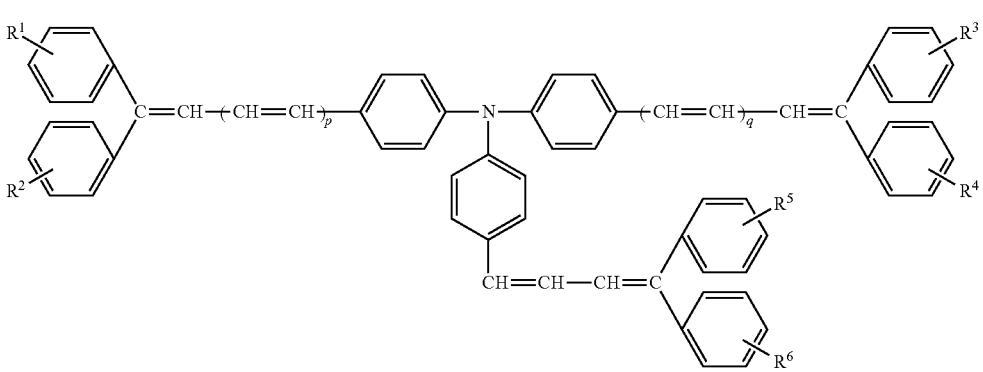

where $R^1$, $R^2$, $R^3$, $R^4$, $R^5$, and $R^6$ each independently represent a hydrogen atom, a lower-alkyl group, an alkoxy group, a phenoxy group, a halogen atom, or a phenyl group unsubstituted or substituted with a group selected from a lower-alkyl group, a lower-alkoxy group, and a halogen atom; and p and q each independently represent 0 or 1.

10. The electrophotographic photoreceptor according to claim 1, wherein the charge generating material includes at least one selected from a hydroxygallium phthalocyanine pigment and a chlorogallium phthalocyanine pigment.

11. A process cartridge detachably attachable to an image forming apparatus, the process cartridge comprising the electrophotographic photoreceptor according to claim 1.

12. An image forming apparatus comprising:

the electrophotographic photoreceptor according to claim 1;

a charging unit that charges a surface of the electrophotographic photoreceptor;

an electrostatic-latent-image forming unit that forms an electrostatic latent image on the charged surface of the electrophotographic photoreceptor;

a developing unit that develops the electrostatic latent image formed on the surface of the electrophotographic photoreceptor with a developer containing a toner in order to form a toner image; and a transfer unit that transfers the toner image onto a surface of a recording medium.

13. The electrophotographic photoreceptor according to claim 1, wherein the outer peripheral surface of the conductive substrate comprises hydroxyl groups, and when the outer peripheral surface of the conductive substrate is directly treated with the silazane, a plurality of the hydroxyl groups and/or a hydrogen atom of the hydroxyl groups are replaced with a silyl group.

14. The electrophotographic photoreceptor according to claim 1, wherein the conductive substrate comprises aluminium, the outer peripheral surface of the conductive substrate comprises hydroxyl groups bonded to aluminium, and when the outer peripheral surface of the conductive substrate is directly treated with the silazane, a plurality of the hydroxyl groups bonded to aluminium (Al—OH) or the hydrogen atom of the hydroxyl groups are replaced with a silyl group "A" to form Al—O-A or Al-A.

* * * * *